US010434634B2

(12) United States Patent
Garber

(10) Patent No.: US 10,434,634 B2
(45) Date of Patent: Oct. 8, 2019

(54) NAILER DRIVER BLADE STOP

(71) Applicant: Black & Decker Inc., Newark, DE (US)

(72) Inventor: Stuart E. Garber, Towson, MD (US)

(73) Assignee: Black & Decker, Inc., Newark, DE (US)

( * ) Notice: Subject to any disclaimer, the term of this patent is extended or adjusted under 35 U.S.C. 154(b) by 501 days.

(21) Appl. No.: 14/498,475

(22) Filed: Sep. 26, 2014

(65) Prior Publication Data

US 2015/0096776 A1 Apr. 9, 2015

Related U.S. Application Data

(60) Provisional application No. 61/961,247, filed on Oct. 9, 2013.

(51) Int. Cl.
*B25C 1/00* (2006.01)

(52) U.S. Cl.
CPC ..... *B25C 1/00* (2013.01); *B25C 1/008* (2013.01)

(58) Field of Classification Search
CPC ..... B25C 1/008; B25C 1/00
USPC ..... 173/1–2, 90; 227/107–156
See application file for complete search history.

(56) References Cited

U.S. PATENT DOCUMENTS 618,085 A 1/1899 Grandy
2,398,544 A * 4/1946 Lockhart ..... A61M 5/30 604/68
2,519,617 A 8/1950 Wember
2,522,931 A 9/1950 Curtiss
2,569,221 A 9/1951 Batten
3,584,776 A * 6/1971 Bolte ..... B25C 1/047 227/130
3,708,095 A 1/1973 Briggs, Jr.
3,711,008 A 1/1973 Clifford et al.
3,908,884 A 9/1975 Schrepferman
4,197,974 A 4/1980 Morton et al.
4,253,598 A 3/1981 Haytayan
4,463,888 A 8/1984 Geist et al.
4,624,401 A 11/1986 Gassner et al.
4,688,710 A 8/1987 Massari, Jr. et al.
4,832,245 A 5/1989 Terayama et al.
4,964,558 A 10/1990 Crutcher et al.
(Continued)

FOREIGN PATENT DOCUMENTS

EP 0387211 A2 9/1990
EP 0927605 A2 7/1999
(Continued)

OTHER PUBLICATIONS

European Search Report, EP 14187710.0-1701, EPO (dated Oct. 15, 2015).

(Continued)

*Primary Examiner* — Robert F Long
(74) *Attorney, Agent, or Firm* — Wright IP & International Law; Eric G. Wright

(57) ABSTRACT

A fastening tool which controls the return behavior of a driver blade by using a blade stop and/or a bumper. The fastening tool can remove the driver blade from the drive path upon its return after driving a fastener into a workpiece and bring the driver blade to a resting state by using a bumper to orient the driver blade out of alignment with the drive path and into contact the driver blade stop.

27 Claims, 29 Drawing Sheets

(56) References Cited

U.S. PATENT DOCUMENTS 5,098,004 A 3/1992 Kerrigan
5,197,647 A 3/1993 Howell
5,231,750 A * 8/1993 Fealey ..... B25C 1/001 173/127
5,297,713 A 3/1994 Perra et al.
5,433,367 A 7/1995 Liu
5,647,525 A * 7/1997 Ishizawa ..... B25C 1/00 227/113
5,873,509 A 2/1999 Liao
6,012,622 A 1/2000 Weinger et al.
6,036,072 A 3/2000 Lee
6,053,389 A 4/2000 Chu et al.
6,131,787 A 10/2000 Curtis
6,213,371 B1 * 4/2001 Cabrera ..... B25C 7/00 227/119
6,237,747 B1 5/2001 Gantner et al.
6,290,115 B1 9/2001 Chen
6,296,167 B1 10/2001 Jen
6,425,306 B1 7/2002 Habermehl
6,604,666 B1 * 8/2003 Pedicini ..... B25C 1/06 173/124
6,679,413 B2 1/2004 Miller et al.
6,705,503 B1 * 3/2004 Pedicini ..... B25C 1/06 173/124
6,772,931 B2 8/2004 Miller et al.
6,880,739 B1 4/2005 Zhu
7,137,541 B2 11/2006 Baskar et al.
7,138,595 B2 11/2006 Berry et al.
7,165,305 B2 1/2007 Kenney et al.
7,204,403 B2 4/2007 Kenney et al.
7,213,732 B2 5/2007 Schell et al.
7,314,155 B2 1/2008 Moeller et al.
7,322,506 B2 1/2008 Forster
7,325,712 B2 2/2008 Schiestl
7,331,403 B2 2/2008 Berry et al.
7,410,085 B2 8/2008 Wolf et al.
7,500,589 B2 3/2009 Wolf et al.
7,503,401 B2 3/2009 Gross et al.
7,513,404 B2 4/2009 Sckolnikov et al.
7,520,414 B2 4/2009 Blessing et al.
7,537,146 B2 5/2009 Schiestl
7,594,547 B2 9/2009 Berry et al.
7,641,089 B2 1/2010 Schell
7,686,199 B2 3/2010 Gross et al.
7,694,863 B2 4/2010 Spasov et al.
7,726,536 B2 6/2010 Gross et al.
7,766,204 B2 8/2010 Spasov et al.
7,789,169 B2 9/2010 Berry et al.
7,861,905 B2 1/2011 Miescher et al.
7,870,988 B2 1/2011 Schiestl et al.
7,922,059 B2 4/2011 Schiestl et al.
7,975,893 B2 7/2011 Berry et al.
7,997,467 B2 8/2011 Hirabayashi et al.
8,011,549 B2 9/2011 Berry et al.
8,088,406 B2 * 1/2012 Potter ..... A61M 5/30 424/426
8,123,099 B2 2/2012 Kenney et al.
8,231,039 B2 7/2012 Buck et al.
8,302,833 B2 11/2012 Gross et al.
8,336,748 B2 12/2012 Hlinka et al.
8,381,960 B2 2/2013 Bruggmueller et al.
8,763,874 B2 * 7/2014 McCardle ..... B25C 1/047 227/129
9,808,924 B2 * 11/2017 Wu ..... B25C 5/06
2002/0053587 A1 * 5/2002 White ..... B25C 1/003 227/131
2003/0042285 A1 3/2003 Wang
2003/0230621 A1 12/2003 Yamamoto et al.
2004/0232194 A1 * 11/2004 Pedicini ..... B25C 1/06 227/131
2005/0218175 A1 10/2005 Schell et al.
2005/0218176 A1 10/2005 Schell et al.
2006/0011694 A1 1/2006 Ishizawa et al.
2006/0016843 A1 1/2006 Ishizawa et al.
2006/0161111 A1 * 7/2006 Potter ..... A61M 37/0069 604/187
2006/0169738 A1 8/2006 Ogawa et al.
2006/0249554 A1 11/2006 Butzen et al.
2007/0075112 A1 4/2007 Porth et al.
2008/0099526 A1 5/2008 Brendel et al.
2008/0251567 A1 10/2008 Shkolnikov et al.
2008/0302846 A1 12/2008 Thompson
2009/0030442 A1 * 1/2009 Potter ..... A61B 5/1411 606/182
2009/0050667 A1 2/2009 Po
2009/0057366 A1 3/2009 Braddock
2009/0250500 A1 10/2009 Brendel et al.
2009/0321492 A1 * 12/2009 Shima ..... B25C 1/06 227/2
2010/0206934 A1 8/2010 Vallon et al.
2011/0062207 A1 3/2011 Hlinka et al.
2011/0132959 A1 6/2011 Hlinka et al.
2011/0180284 A1 * 7/2011 Carrier ..... B25F 5/00 173/1
2012/0097729 A1 4/2012 Gross et al.
2013/0233903 A1 9/2013 Brendel et al.
2014/0054350 A1 * 2/2014 Pedicini ..... B25C 5/15 227/8

FOREIGN PATENT DOCUMENTS

EP 2002935 A2 12/2008
WO 2007126735 A2 11/2007

OTHER PUBLICATIONS

Extended European Search Report, Application No. 17161681.6 - 1019 / 3213872, EPO (Aug. 2, 2018).
Extended European Search Report, Application No. 13170109.6 - 1701 / 2669055, EPO (Jun. 2, 2016).
Extended European Search Report, Application No. 13170119.5 - 1707 - 2669059, EPO (Apr. 29, 2016).
Extended European Search Report, Application No. 13170116.1 - 1019 / 2669058, EPO (Mar. 20, 2018).

* cited by examiner

NAILER DRIVER BLADE STOP

CROSS-REFERENCE TO RELATED APPLICATIONS

This patent application is a non-provisional application of and claims the benefit of the filing date of copending U.S. provisional patent application No. 61/961,247 entitled "Nailer Driver Blade Stop" filed on Oct. 9, 2013, and having confirmation number 9763.

FIELD OF THE INVENTION

The present invention relates to a nailer driver blade stop for a fastening tool.

INCORPORATION BY REFERENCE

This patent application incorporates by reference in its entirety copending U.S. provisional patent application No. 61/961,247 entitled "Nailer Driver Blade Stop" filed on Oct. 9, 2013, and having confirmation number 9763.

BACKGROUND OF THE INVENTION

Fastening tools, such as nailers, are used in the construction trades. However, many fastening tools which are available do not provide an operator with fastener driving mechanisms which exhibit reliable fastener driving performance. Many available fastening tools do not adequately guard the moving parts of a nailer driving mechanism from damage. These failures are even more pronounced during high energy and/or high-speed driving. Improper driving of fasteners, failure of parts and damage to the tool can occur. Additionally, undesired driver blade recoil and/or undesired driver blade return dynamics can frequently occur and can result in misfires, jams, damage to the tool and loss of work efficiency. This recoil energy in the driver blade can frequently cause an unintentional driving of a second fastener. In the case of a cordless nailer having mechanical return springs, this unintentional driving of a second nail can be very common. Unintentionally driving a second nail can risk damage to the work surface, jams, misfires, or tool failures. Many available fastening tools experience misfire and produce unacceptable rates of damaged fasteners when fired. Further, many available fastening tools do not adequately guard the moving parts of a nailer driving mechanism from damage.

In addition to the above, many available cordless nailer designs which do not use a piston cylinder arrangement are only capable of driving finish nails. They are unable to drive fasteners into concrete and/or metal. They are also inadequate to drive fasteners into various types of hard or dense construction materials. There is a strong need for a reliable and an effective fastener driving mechanism.

SUMMARY OF THE INVENTION

The invention in its many and varied embodiments disclose herein solves the problems regarding control of a driver blade during its return phase after driving a nail into a workpiece. It reduces or eliminates misfires resulting from the recoil or undesired driver blade return dynamics of the driver blade after driving a fastener into a workpiece.

In an embodiment, a fastening tool can have a nail driving axis; a driver blade configured to drive a nail along the nail driving axis into a workpiece during a nail driving phase; the driver blade having a driver blade axis; and the driver blade axis can be configured out of alignment with the nail driving axis during a portion of a return phase. The fastening tool can further have a bumper adapted for reversible contact by the driver blade during the return phase. The fastening tool can also have a bumper configured to cause the driver blade axis to have a configuration out of alignment with the nail driving axis. The bumper can have a surface configured to cause the driver blade axis to have a configuration out of alignment with the nail driving axis. Additionally, the fastening tool can have a driver blade having a surface of a portion of the driver blade configured to cause the driver blade axis to have a configuration out of alignment with the nail driving axis.

In an embodiment, the fastening tool can have a surface of the driver blade, or a portion of the driver blade, which is configured to cause the driver blade axis to be out of alignment with the nail driving axis and adapted to have a reversible contact with at least a portion of a bumper during at least a portion of the return phase. The fastening tool can also have a driver blade axis which forms an angle with the nail driving axis during at least a portion of the return phase.

The fastening tool can also have a driver blade guide member configured to guide the driver blade to configure the driver blade axis to have an orientation at an angle with the nail driving axis during at least a portion of the return phase.

In an embodiment, the fastening tool can have the driver blade axis configured generally parallel to the nail driving axis during at least a portion of the nail driving phase. In another embodiment, the fastening tool can have the driver blade axis generally aligned with the nail driving axis during at least a portion of the nail driving phase. In yet another embodiment, the fastening tool can have the driver blade axis generally collinear to the nail driving axis during the nail driving phase.

The fastening tool can also have a driver blade stop configured to have a reversible contact with at least a portion of a driver blade. In an embodiment, the driver blade can be configured to impact the driver blade, or a portion of the driver blade, to a driver blade stop during the return phase. In an embodiment, a portion of the driver blade is proximate to a magnet during a portion of the return phase. In an embodiment, the fastening tool can have a magnet which magnetically attracts at least a portion of the driver blade during the return phase.

In an embodiment, at least a portion of a bumper and at least a portion of the driver blade can form a pivot angle upon their initial contact of the bumper and the driver blade. In an embodiment, the fastening tool can have a bumper adapted for impact by the driver blade during a portion of the return phase; a driver blade stop adapted for impact by the driver blade during a portion of the return phase; and a magnet which magnetically attracts at least a portion of the driver blade during a portion of the return phase. The value of the pivot angle can determine the rebound angle between the nailer profile axis and the nail channel centerline.

In an embodiment, the power tool can use a method of controlling rebound in a fastening tool, which can have the steps of: providing a driver blade; providing a bumper; providing a blade stop; guiding the driver blade, or at least a portion of the driver blade, to contact the bumper during at least a portion of the return phase; and guiding the driver blade, or at least a portion of the driver blade, toward the driver blade stop during a portion of the return phase. The method of controlling rebound in a fastening tool can also have the step of reversibly contacting the driver blade, or at least a portion of the driver blade, with the driver blade stop.

The method of controlling rebound in a fastening tool can also have the steps of: providing the bumper, wherein the bumper has at least an impact portion which is adapted to receive an impact from the driver blade; the bumper receiving an impact from the driver blade, such as reversibly impacting at least a portion of the driver blade into the bumper, such as into the impact portion; and configuring a driver blade axis to have an angle greater than zero with a nail driving axis as a result of said impacting during at least a portion of the return phase. In an embodiment, the method of controlling rebound in a fastening tool can further have the step of providing the bumper which has a surface configured to provide a pivot angle. In another embodiment, the method of controlling rebound in a fastening tool can also have the step of reversibly deforming the bumper by contact by the driver blade. In another embodiment, the method of controlling rebound in a fastening tool can further have the step of providing the driver blade, wherein the driver blade has a surface configured to provide a pivot angle.

In an embodiment, a driver blade return mechanism can have a profile return guide member which guides a driver blade during at least portion of a return phase; and a blade stop adapted for reversible contact by at least a portion of the profile during a portion of said return phase.

In an embodiment, a fastening tool can have a driver blade stop adapted for reversible contact by at least a portion of a tip of a driver blade.

BRIEF DESCRIPTION OF THE DRAWINGS

The present invention in its several aspects and embodiments solves the problems discussed above and significantly advances the technology of fastening tools. The present invention can become more fully understood from the detailed description and the accompanying drawings, wherein.

Herein, like reference numbers in one figure refer to like reference numbers in another figure.

DETAILED DESCRIPTION OF THE INVENTION

In a fastening tool such as a nailer, energy effects associated with the return of a driver blade after driving a nail can cause the driver blade to move in unpredictable and hard to control manners which can cause a misfire or mechanical damage to the fastening tool. The embodiments disclosed herein solve the problems regarding driver blade movement during the return phase.

The inventive fastening tool can have of a variety of designs and can be powered by a number of power sources. For example, power sources for the fastening tool can be manual, pneumatic, electric, combustion, solar or use other (or multiple) sources of energy. In an embodiment, the fastening tool can be cordless and the driver blade stop can be used in a framing nailer, wood nailer, concrete nailer, metal nailer, steel nailer, or other type of nailer, or fastening tool. The nailer driver blade stop can be used in a broad variety of nailers whether cordless, with a power cord, gas assisted, or of another design.

The nailer driver blade stop disclosed herein can be used with fastening tools, including but not limited to, nailers, drivers, riveters, screw guns and staplers. Fasteners which can be used with the driver blade stop can be in non-limiting examples, roofing nails, finishing nails, duplex nails, brads, staples, tacks, masonry nails, screws and positive placement/metal connector nails, pins, rivets and dowels. The inventive fastening tool can be used to drive fasteners into a broad variety of work pieces, such as wood, composites, metal, steel, drywall, amorphous materials, concrete and other hard and soft building materials.

In an embodiment the nailer driver blade stop can be used with framing (metal or wood), fencing, decking, basement water barriers, furring strips in concrete structures (carpet tack strips). In an embodiment, the nailer driver blade stop can be used with cordless nailers having high drive energies, such as to drive fasteners into concrete, framing, metal connecting, structural steel, composites, or for duplex stapling.

Additional areas of applicability of the present invention can become apparent from the detailed description provided herein. For example, the inventive nailer driver blade stop in its several embodiments and many aspects can be employed for use with fastening tools other than nailers and can be used with fasteners other than nails, such as pins. The detailed description and specific examples herein are not intended to limit the scope of the invention.

Figure 1:
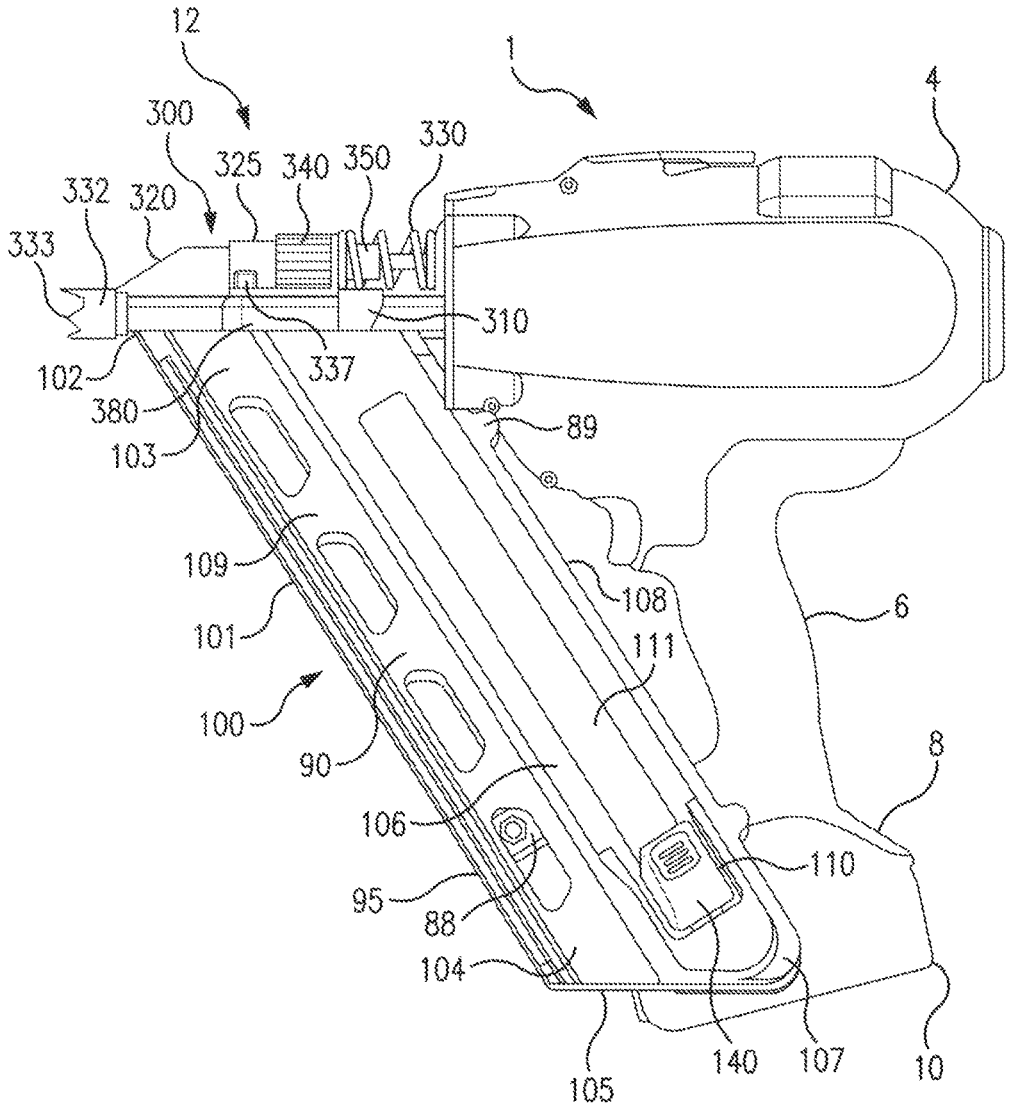
FIG. 1 is a knob-side side view of an exemplary nailer having a fixed nosepiece assembly and a magazine.

FIG. 1 is a side view of an exemplary nailer having a magazine viewed from the pusher side 90 and showing the pusher 140. A magazine 100 which is constructed according to the principles of the present invention is shown in operative association with a nailer 1. In this FIG. 1 example, nailer 1 is a cordless nailer. However, the nailer can be of a different type and/or a different power source.

Nailer 1 has a housing 4 and a motor, which can be covered by the housing 4, that drives a nail driving mechanism for driving nails fed from the magazine 100. A handle 6 extends from housing 4 to a base portion 8 having a battery pack 10. Battery pack 10 is configured to engage a base portion 8 of handle 6 and provides power to the motor such that nailer 1 can drive one or a series nails fed from the magazine 100.

Nailer 1 has a nosepiece assembly 12 which is coupled to housing 4. The nosepiece can be of a variety of embodiments. In a non-limiting example, the nosepiece assembly 12 can be a fixed nosepiece assembly 300, or a latched nosepiece assembly.

The magazine 100 can optionally be coupled to housing 4 by coupling member 89. The magazine 100 has a nose portion 103 which can be proximate to the fixed nosepiece assembly 300. The nose portion 103 of the magazine 100 which has a nose end 102 that engages the fixed nosepiece assembly 300. A base portion 104 of magazine 100 by base coupling member 88 can be coupled to the base portion 8 of a handle 6. The base portion 104 of magazine 100 is proximate to a base end 105 of the magazine 100. The magazine can have a magazine body 106 with an upper magazine 107 and a lower magazine 109. An upper magazine edge 108 is proximate to and can be attached to housing 4. The lower magazine 109 has a lower magazine edge 101.

The magazine includes a nail track 111 sized to accept a plurality of nails 55 therein. The upper magazine 107 can guide at least one end of a nail. In another embodiment, lower magazine 109 can guide another portion of the nail or another end of the nail. In an embodiment, the plurality of nails 55 can have nail tips which are supported by a lower liner 95. The plurality of nails 55 are loaded into the magazine 100 by inserting them into the nail track 111 through a nail feed slot which can be located at or proximate to the base end 105. The plurality of nails 55 can be moved through the magazine 100 towards the fixed nosepiece assembly 300, or generally, the nosepiece assembly 12, by a force imparted by contact from the pusher assembly 110. Individual or collated nails can be inserted into the magazine 100 for fastening.

FIG. 1 illustrates an example embodiment of the fixed nosepiece assembly 300 which has an upper contact trip 310 and a lower contact trip 320. The lower contact trip 320 can be guided and/or supported by a lower contact trip support 325. The fixed nosepiece assembly 300 also can have a nose 332 which can be designed to have a nose tip 333. When the nose 332 is pressed against a workpiece, the lower contact trip 320 and the upper contact trip 310 can be moved toward the housing 4 and a contact trip spring 330 is compressed.

The fixed nosepiece assembly 300 is adjustable and has a depth adjust member that allows the user to adjust the driving characteristics of the fixed nosepiece assembly 300. In the embodiment of FIG. 1, a depth adjustment wheel 340 can be rotated to affect the position of a depth adjustment rod 350. The position of the depth adjustment rod 350 also affects the distance between nose tip 333 and insert tip 355 (e.g. FIG. 2A). In an embodiment, depth adjustment can be achieved by changing the relative distance between the upper contact trip 310 and the lower contact trip 320.

In an embodiment, the magazine 100 is adapted to hold a means for releasing the fixed nosepiece 300 from the magazine 100. In an embodiment, one or more of a magazine screw 337 can be used to reversibly fix the nosepiece assembly 300 to the magazine 100. The fixed nosepiece assembly 300 can fit with the magazine 100 by a magazine interface 380.

In an embodiment, the pusher assembly 110 can be placed in an engaged state by the movement of the pusher 140 into the nail track 111 and in the direction of loading fasteners (e.g. nails) to push the plurality of nails 55 toward the nose end 102. The pusher 140 can be reversibly fixed in place or secured against movement out of a retracted state. In an embodiment, the magazine can pivot away from the fixed nosepiece assembly.

Figure 2:
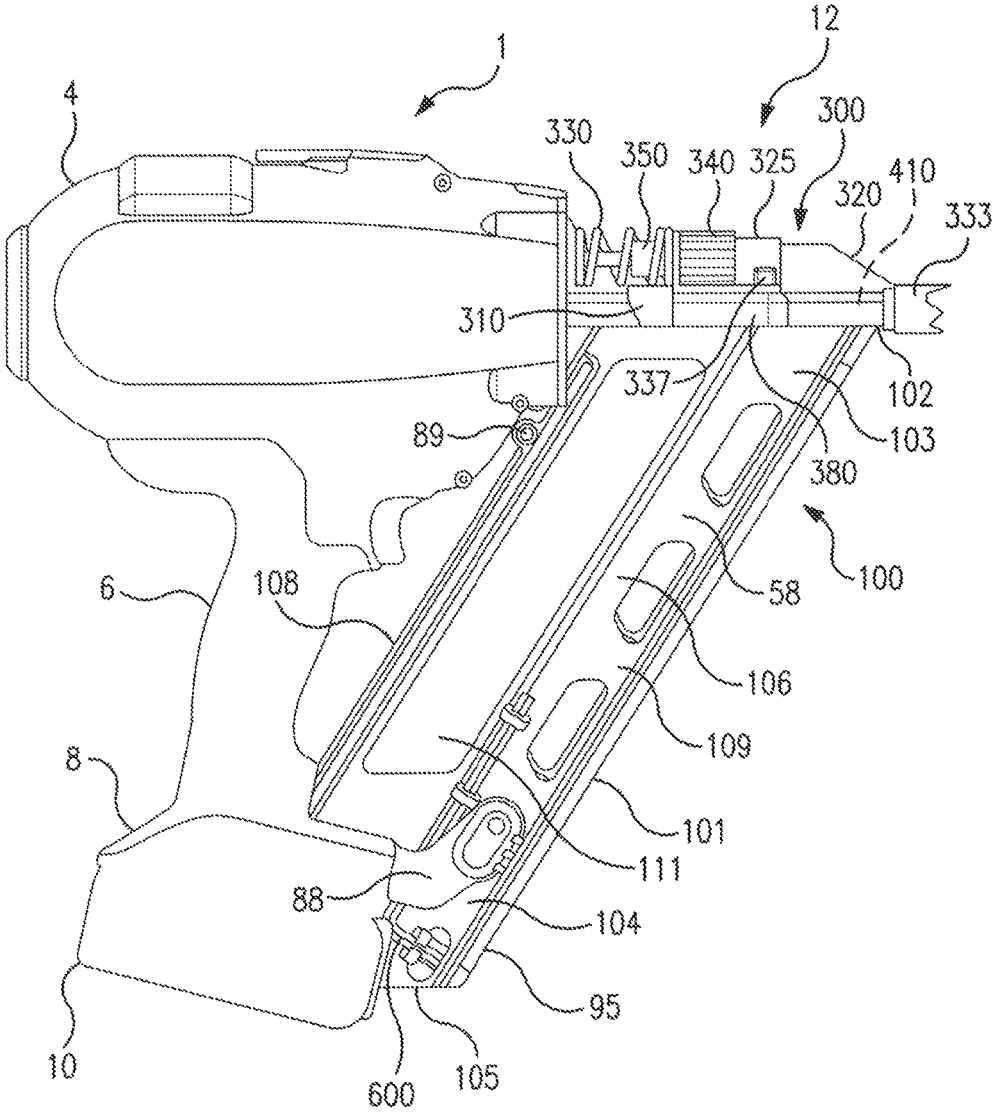
FIG. 2 is a nail-side view of an exemplary nailer having a fixed nosepiece assembly and a magazine.

FIG. 2 is a side view of exemplary nailer 1 viewed from a nail-side 58. Allen wrench 600 is illustrated as reversibly secured to the magazine 100.

Figure 2A:
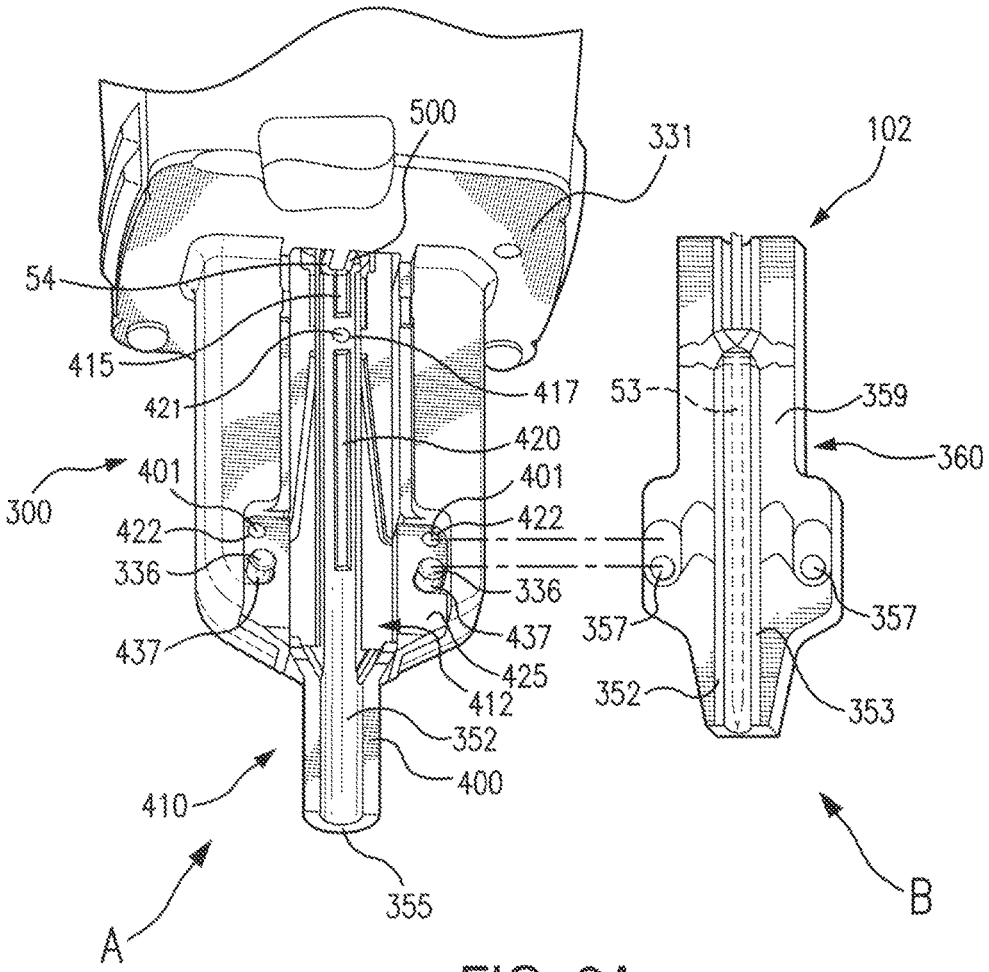
FIG. 2A is a detailed view of a fixed nosepiece with a nosepiece insert and a mating nose end of a magazine.

FIG. 2A is a detailed view of the nosepiece assembly 300 from the channel side 412 which mates with the nose end 102 of the magazine 100. A nosepiece insert 410 and the nose end 102 of the magazine 100 can be reversibly fit together by a fastening means. In an embodiment, the magazine screw 337 can be turned to reversibly fit nosepiece insert 410 and the nose end 102 together. In an embodiment, the nail channel 352 can be formed when the nosepiece insert 410 is mated with the nose end 102 of the magazine 100.

FIG. 2A detail A illustrates a detail of the nosepiece insert 410 from the channel side 412. As illustrated, the nosepiece insert 410 has a rear mount screw hole 417 for a nail guide insert screw 421. Nosepiece insert 410 can also have a blade guide 415 and nail stop 420. Nosepiece insert 410 can be fit to nosepiece assembly 300. Nosepiece insert 410 can also have a nosepiece insert screw hole 422 within one or more of an interface seat 425 to secure the nosepiece insert into the fixed nosepiece assembly 300.

In an embodiment, the nosepiece insert 410 has a nose 400 with an insert tip 355 and is inserted into the fixed nosepiece assembly 300. In an embodiment, the nosepiece insert 410 is configured such that a driver blade 54 overlaps at least a portion of a blade guide 415 which optionally can extend under a nose plate 33 mounted on a forward face of the housing 4.

Figure 2B:
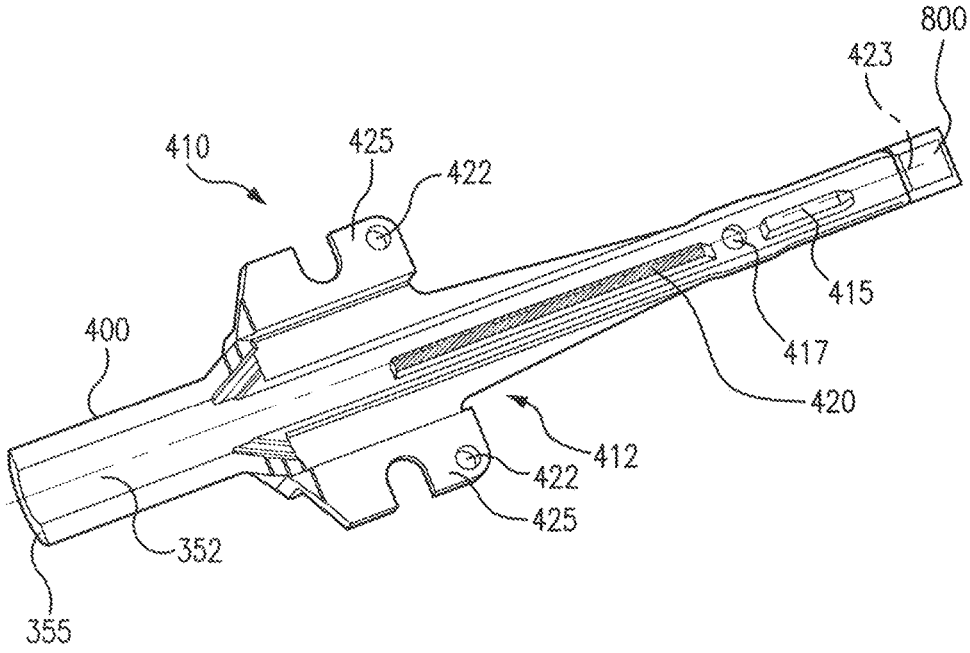
FIG. 2B is a detailed view of a nosepiece insert having a blade stop viewed from the channel side.
Figure 2C:
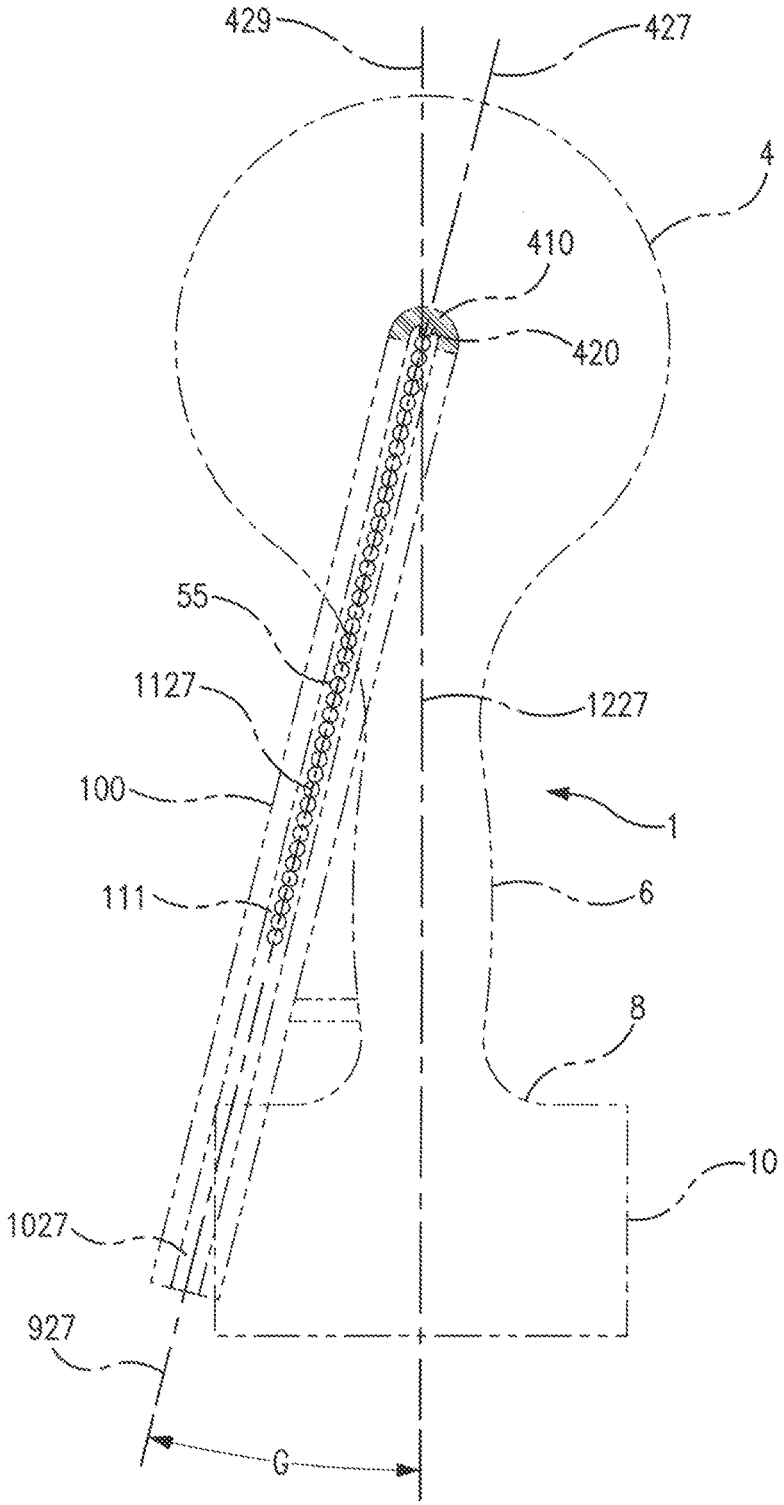
FIG. 2C is a perspective view illustrating the alignment of the nailer, magazine, nails and nail stop.
Figure 2D:
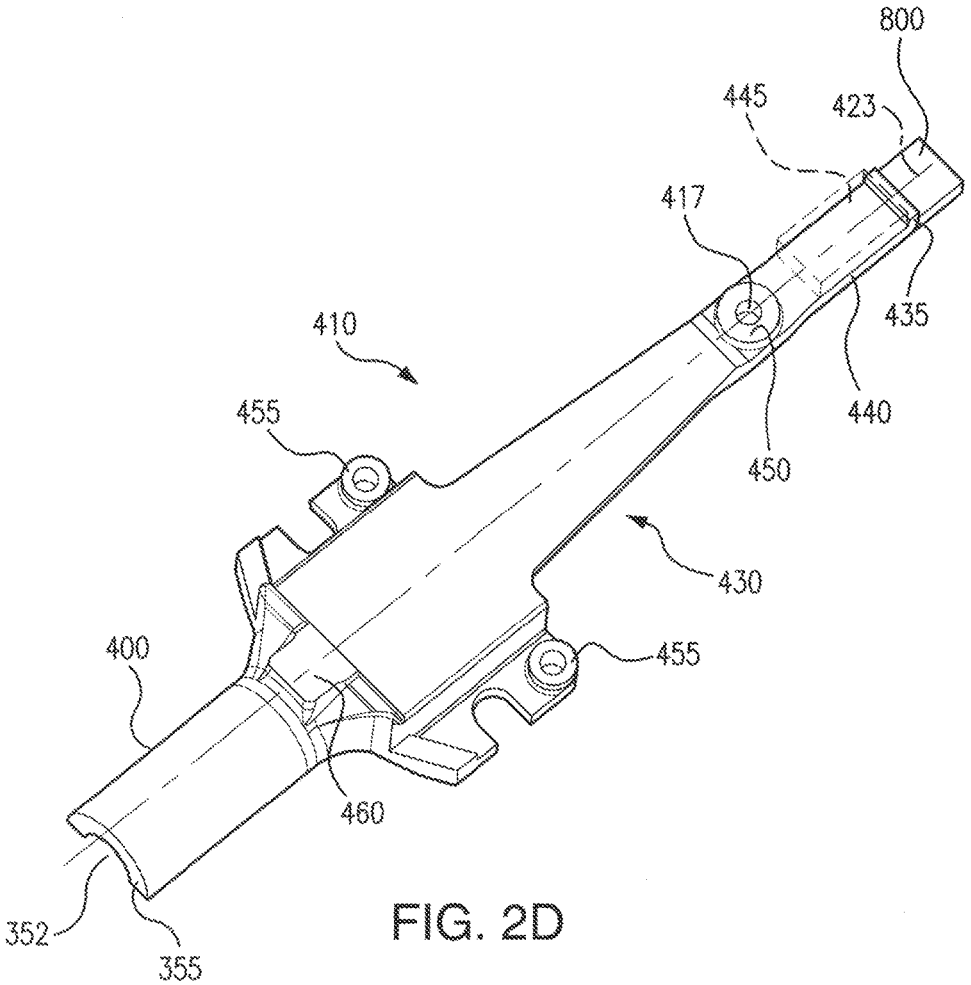
FIG. 2D is a detailed view of a nosepiece insert having a blade stop viewed from the fitting side.

Nosepiece insert 410 can be secured to the fixed nosepiece assembly 300 by one or more of a nosepiece insert screw 401 through a respective insert screw hole 422. The nosepiece insert 410 can be investment cast, such as from investment cast steel. In an embodiment, the nosepiece insert 410 can be made at least in part from 8620 carbonized steel, which can optionally be investment cast 8620 carbonized steel. In an embodiment, the driver blade stop 800 can be a portion of, or a piece attached to, the nosepiece insert 410 (FIGS. 2B and 2D). In an embodiment, the material used to construct the driver blade stop 800 can be a hard and/or hardened material and can be impact resistant to avoid wear. The nailer driver blade 54, and a blade stop 800 (FIG. 2B) can be investment cast 8620 carbonized steel. In an embodiment, the driver blade stop 800 can be made of case hardened AISI 8620 steel, or other hardened material, such as used for the nosepiece insert, or other part which is resistant to wear from moving parts or moving fasteners.

In an embodiment, the nosepiece insert 410 can be joined to the fixed nosepiece assembly 300 by a nail guide insert screw 421 through the rear mount screw hole 417, or can be a separate piece attached to the nosepiece insert 410 (FIGS. 2B and 2D). One or more prongs 437 on the fixed nosepiece assembly 300 can respectively have a screw hole 336 for inserting the magazine screw 337.

FIG. 2A detail B is a front detail of the face of the nose end 102 having nose end front side 360. The nose end 102 can have a nose end front face 359 which fits with channel side 412. The nose end 102 can have a nail track exit 353. For example, a loaded nail 53 is illustrated exiting nail track exit 353. A screw hole 357 for magazine screw 337 that secures the nose end 102 to the nosepiece assembly 300 is also shown.

FIG. 2B is a detailed view of a nosepiece insert 410 viewed from the channel side 412. The nosepiece insert 410 has a nose 400, an insert tip 355, and an insert centerline 423. The channel side 412 has a blade guide 415 and a nail stop 420. In an embodiment, the nail stop 420 can be in line with said plurality of nails 55 along a nail stop centerline 427 (FIG. 2C). The nail stop centerline 420 is offset from the insert centerline 423 which achieves the receipt of nails to the nail stop 420 in a configuration in which the longitudinal axis 1127 of the plurality of nails 55 (FIG. 2C) is collinear, or parallel in alignment, with the longitudinal centerline 1027 of the nail track 111.

FIG. 2C is a perspective view illustrating the alignment of an embodiment of the nailer 1, magazine 100, plurality of nails 55 and nail stop 420. FIG. 2C illustrates the nail stop 420, the nail stop centerline 427, a longitudinal centerline 927 of the magazine 100, a longitudinal centerline 1027 of the nail track 111, a longitudinal centerline 1127 of the plurality of nails 55 and a longitudinal centerline 1227 of the nailer 1.

Offset angle G is 14 degrees. In an embodiment, nail stop centerline 427 can be collinear with a longitudinal centerline 927 of the magazine 100, a longitudinal centerline 1027 of the nail track 111 and the longitudinal centerline 1127 of the plurality of nails 55. A wide range of angles and orientations for the nail stop 420 can be used.

FIG. 2D is a detailed view of the nosepiece insert 410 viewed from the fitting side 430. Optionally, the fitting side 430 can have a magnet stop 435 and a magnet seat 440 which are adapted for the mounting of a nosepiece magnet 445.

The fitting side 430 can have a rear mount 450, and a mount 455 that receives a screw to secure nosepiece insert 410 to the fixed nosepiece assembly 300. The fitting side 430 can have lower trip seat 460 which fits into a portion of nosepiece assembly 300. In another embodiment, at least a portion of insert 410 can have magnetic properties. A magnetic portion of insert 410 can be used to guide the driver blade 54.

Figure 3:
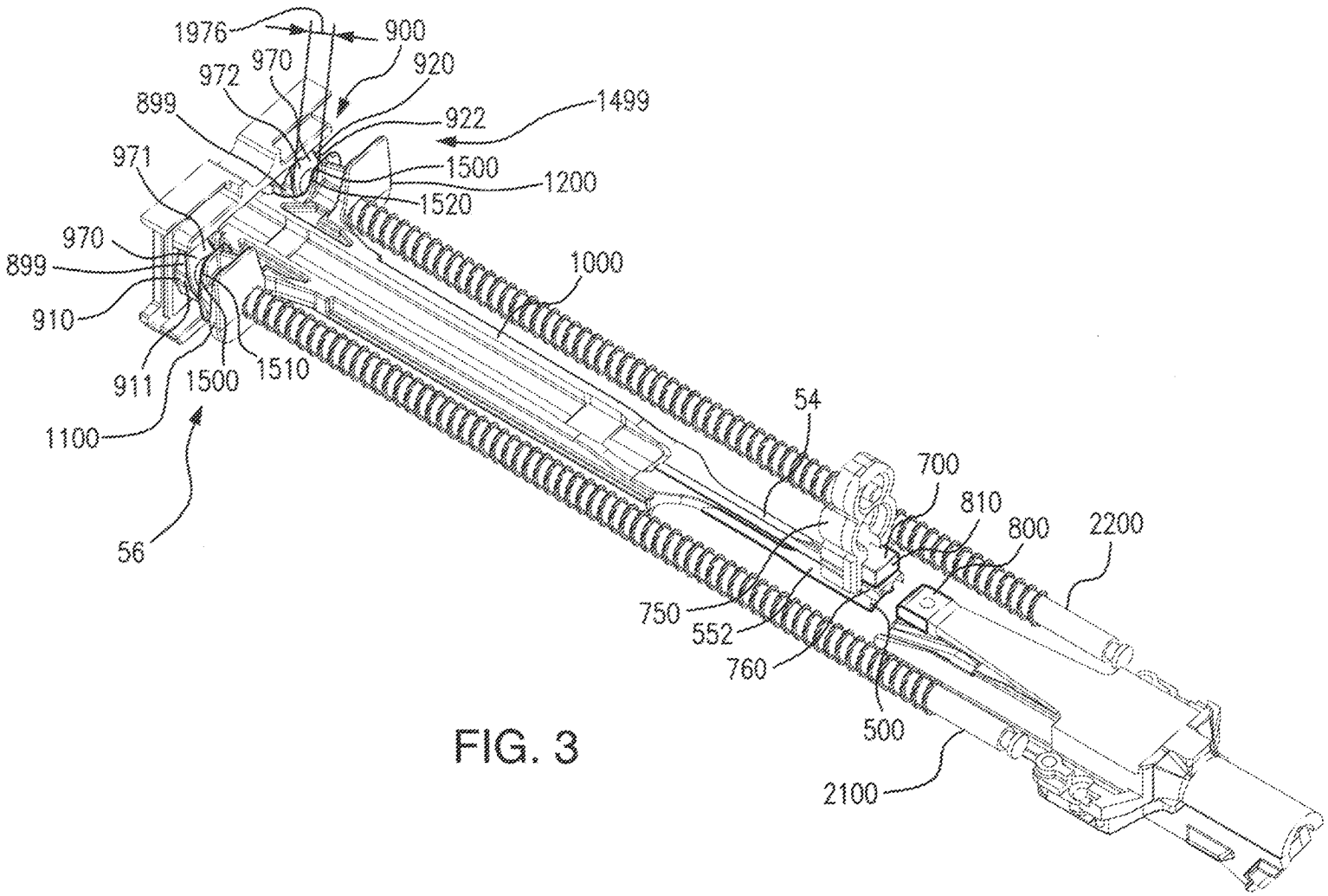
FIG. 3 is a first perspective view of a driver blade in conjunction a return bumper system.

FIG. 3 is a perspective view of the driver blade 54 in conjunction with a return bumper system 900. In an embodiment, the return bumper system 900 can control the movement of the driver blade 54 during a return phase after driving the loaded nail 53. The return bumper system 900 can have a bumper 899 having a bump surface 970 against which a pivot portion 1499 having a pivot surface 1500 of the tail portion 56, can impact during the return phase. As shown in FIG. 3 a single of the bumper 899 having a single of the bump surface 970 can be used.

Herein, the "bumper 899" is a reference to one or more bumpers used to form the return bumper system 900. Herein, the "pivot portion 1499" is a reference to one or more portions of driver blade 54 that impact the return bumper system 900 and that are used to contribute to the pivoting of the driver blade 54 upon impact with one or more of the bumper 899. Herein, the "pivot surface 1500" is a reference to one or more pivot surfaces of the return bumper system 900.

FIG. 3 shows an example embodiment of the driver blade 54, the blade stop 800, the return bumper system 900 and a home magnet 700. The driver blade 54 has two projections, herein referred to as driver blade ears, and respectively referred to as a first driver blade ear 1100 and second driver blade ear 1200. In this example, the total surface area which constitutes the pivot surface 1500 is separated into two portions with one portion on each ear. Specifically, the first driver blade ear 1100 can have a first pivot surface 1510 and the second driver blade ear 1200 can have a second pivot surface 1520.

Because the example embodiment of FIG. 3 has a first driver blade ear 1100 and second driver blade ear 1200, the return bumper system 900 has two of the bumper 899. A first bumper 910 having a first bump surface 971 is configured to receive an impact from the first driver blade ear 1100. A second bumper 920 having a second bump surface 972 is configured to receive an impact from the second driver blade ear 1200.

At the moment of impact by the driver blade 54 upon the return bumper system 900, FIG. 3 shows the first pivot surface 1510 in tangential contact with the first bumper 910, as well as the second pivot surface 1520 in tangential contact with a second bumper 920.

Figure 3A:
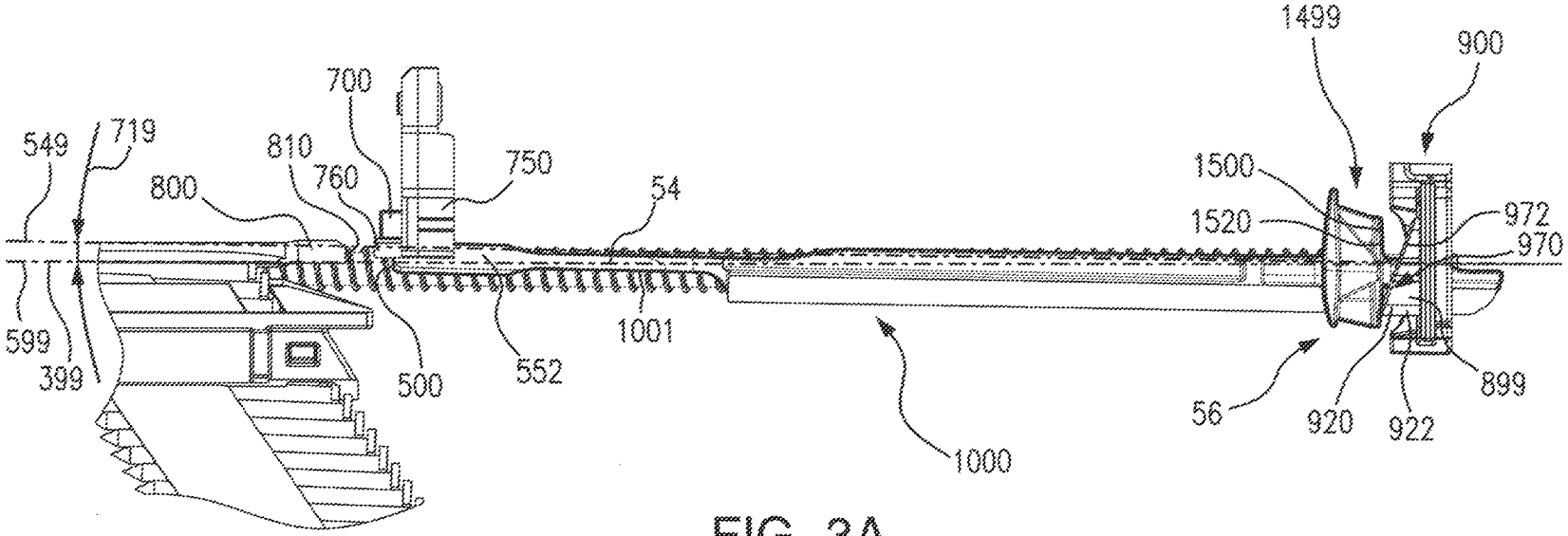
FIG. 3A shows a driver blade at a home position.
Figure 3B:
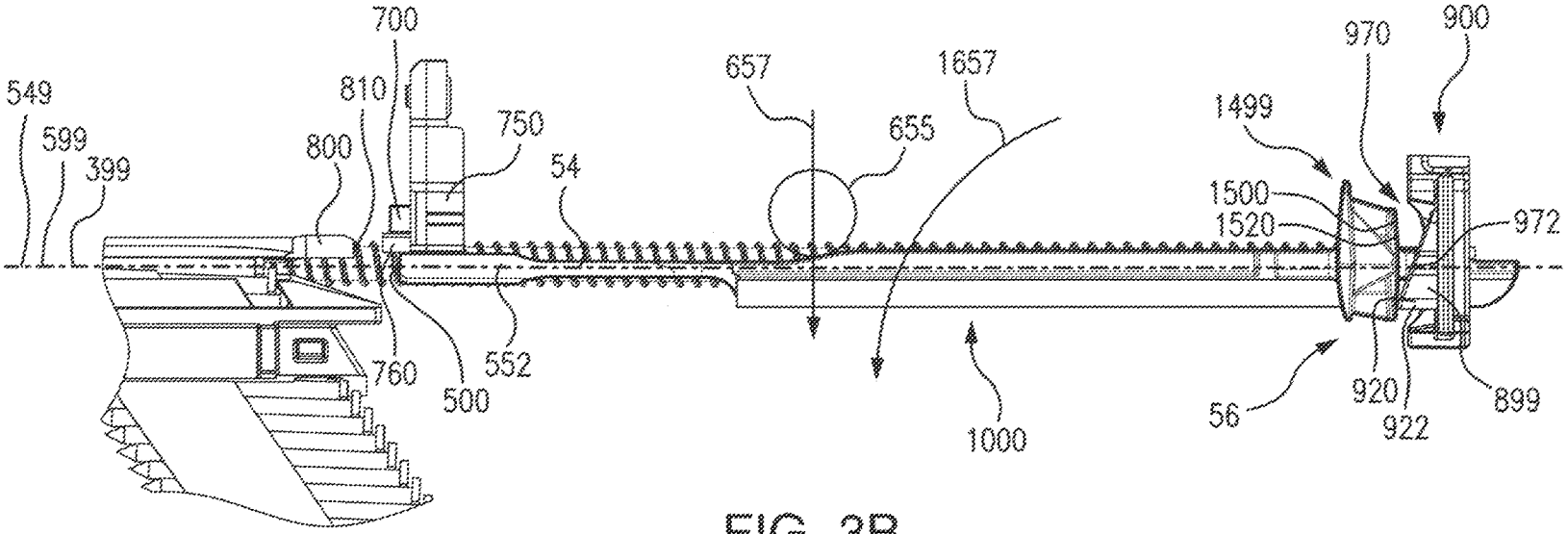
FIG. 3B shows a driver blade aligned to be driven to drive a nail.
Figure 3C:
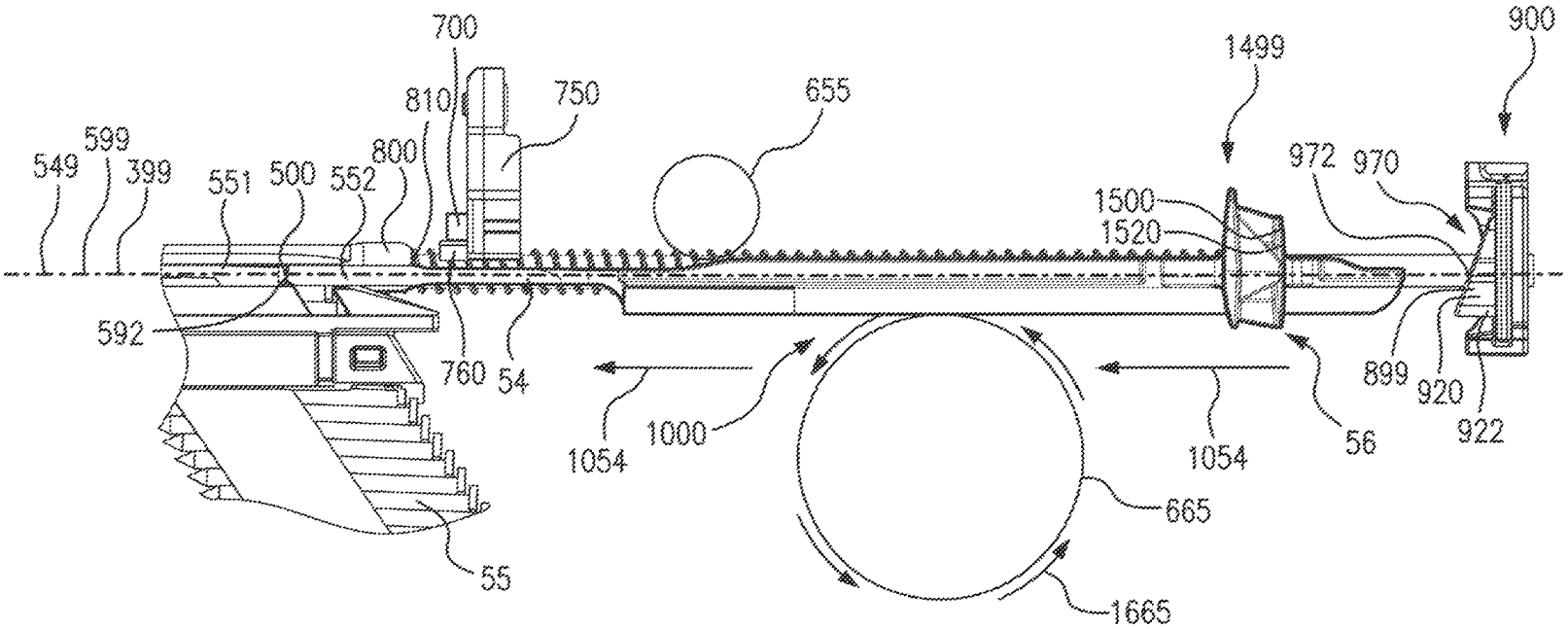
FIG. 3C shows a driver blade being driven and contacting the head of a nail.
Figure 3D:
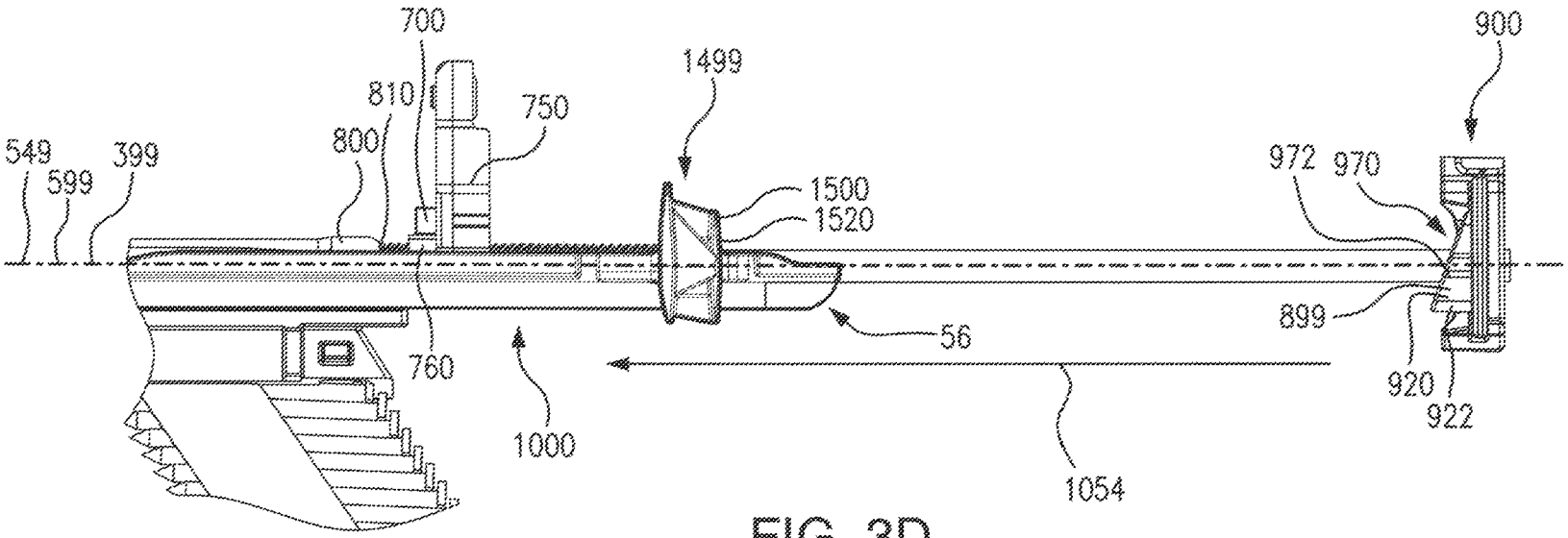
FIG. 3D shows a driver blade positioned for driving a nail into a workpiece.
Figure 3E:
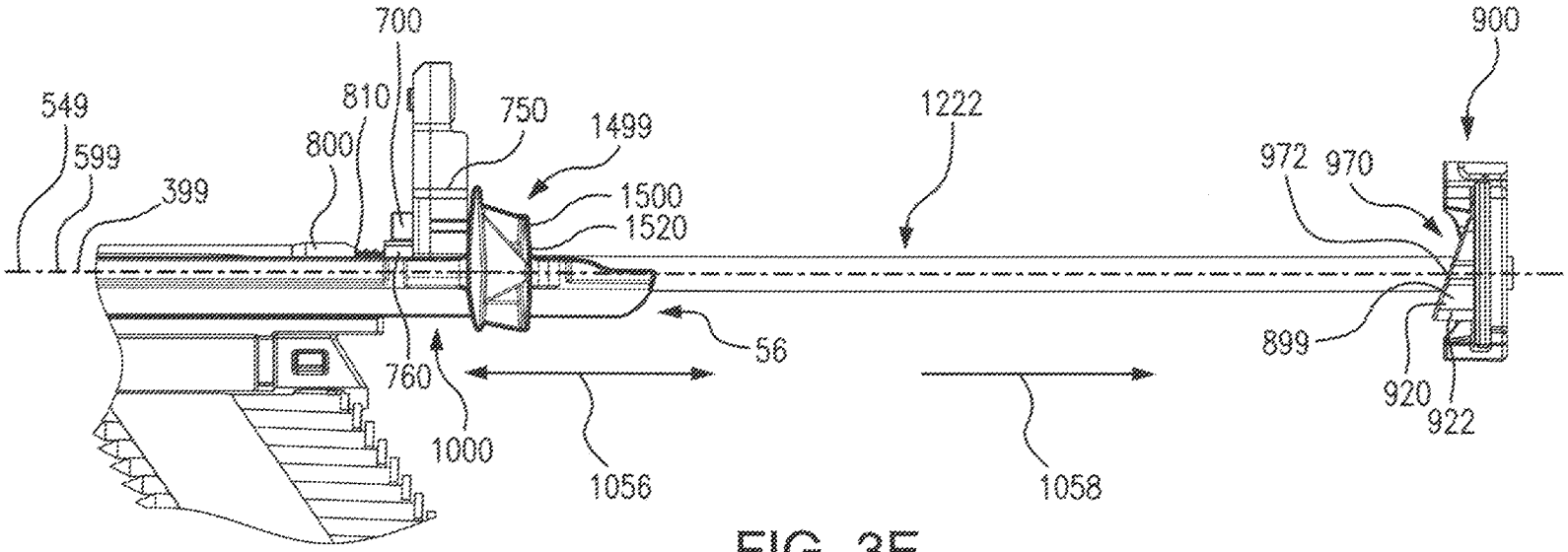
FIG. 3E shows a driver blade beginning a return phase.
Figure 3F:
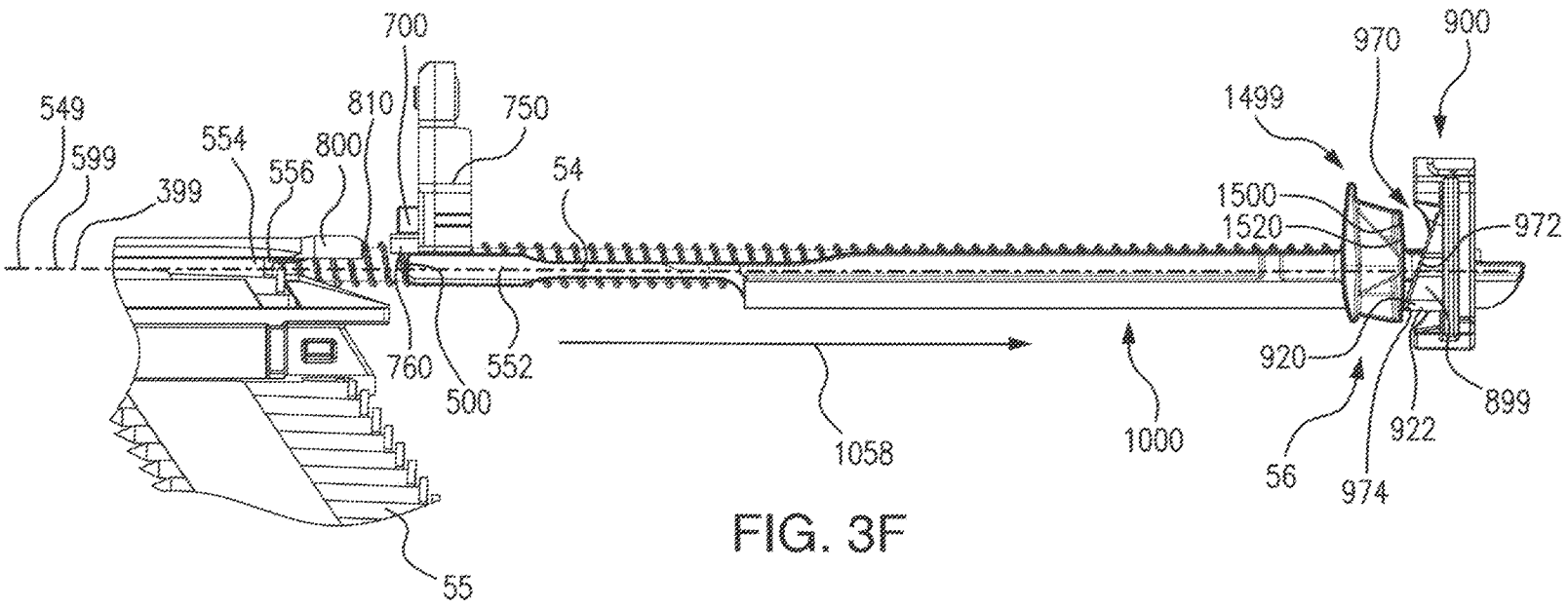
FIG. 3F shows a driver blade making contact with a bumper.
Figure 3G:
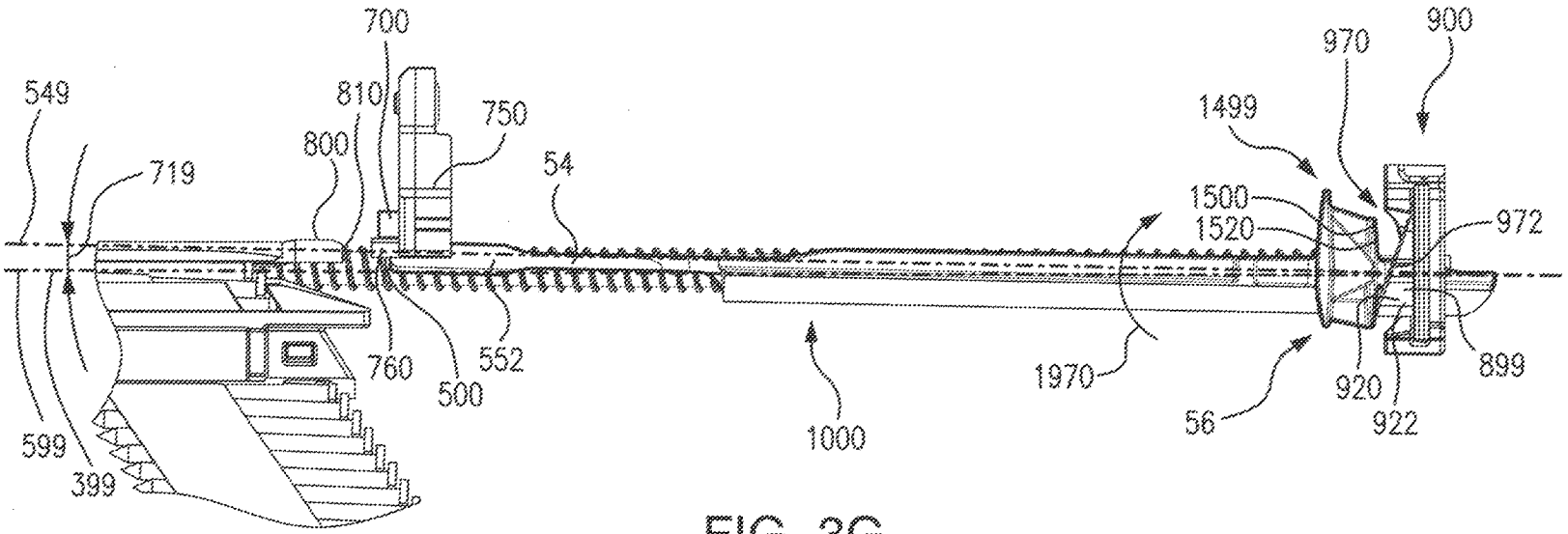
FIG. 3G shows a driver blade pivoting into alignment to strike a blade stop.
Figure 3H:
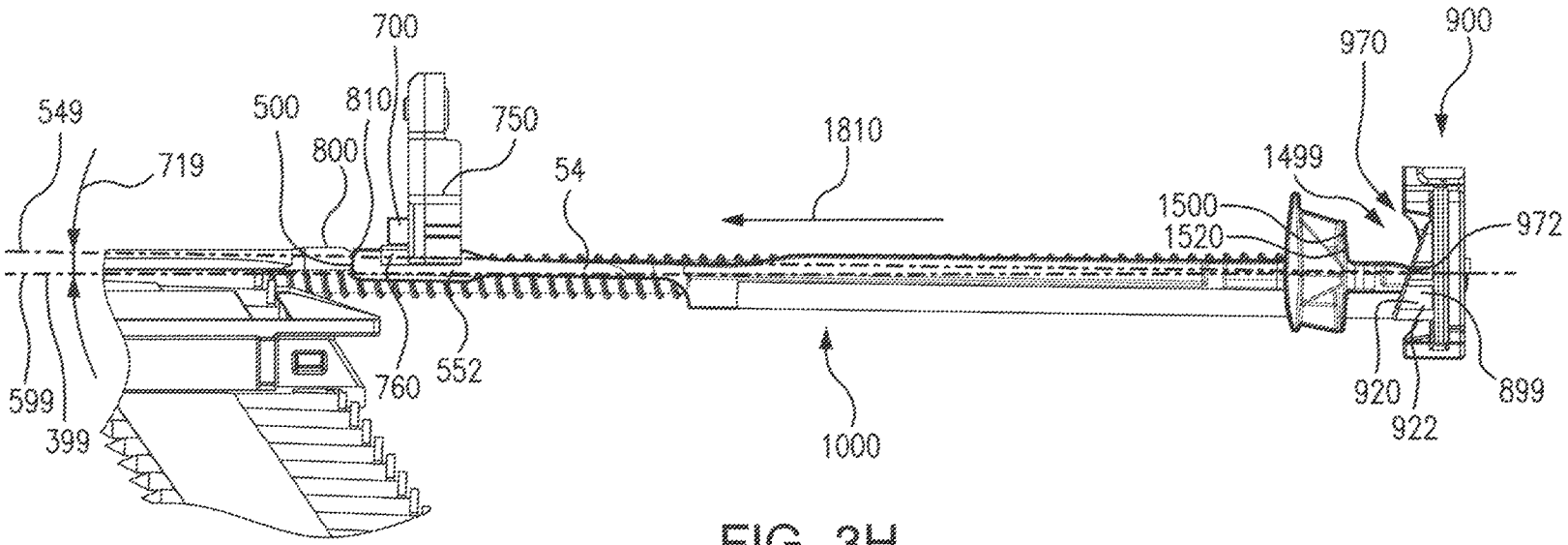
FIG. 3H shows a driver blade tip striking the driver blade stop.
Figure 3I:
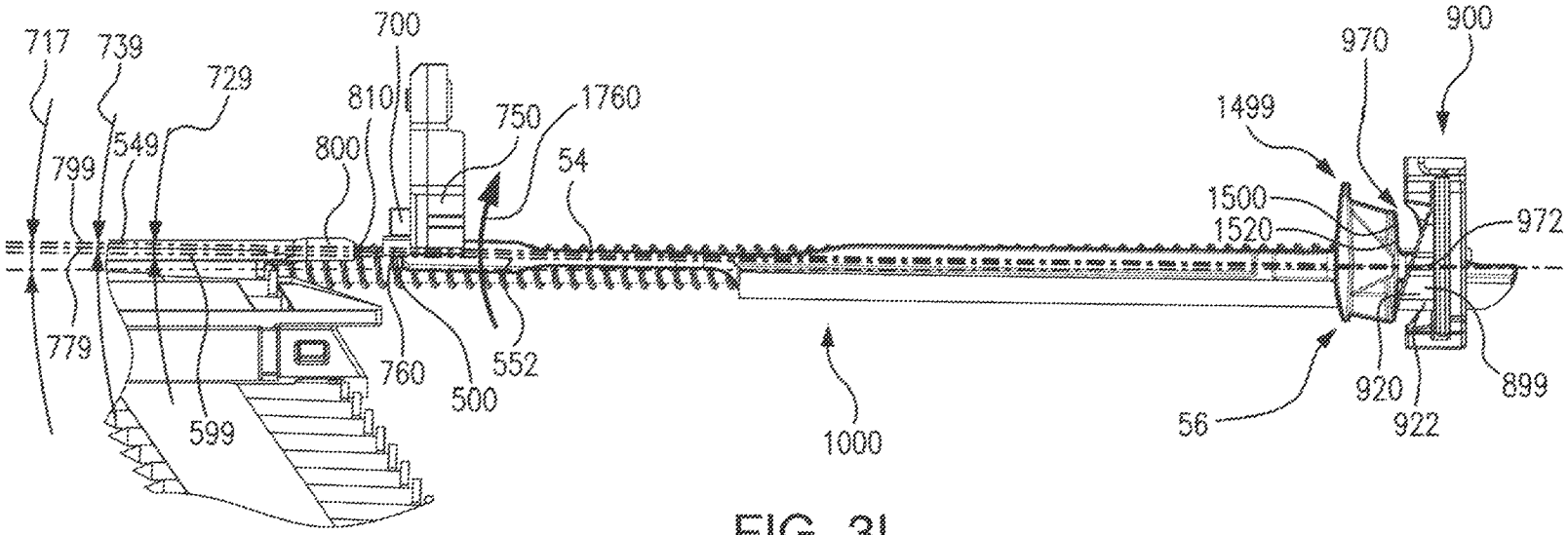
FIG. 3I shows a driver blade being drawn into the home position.

The simultaneous interactions of the first pivot surface 1510 against the first bump surface 971 and the second pivot surface 1520 against the second bump surface 972 will cause the driver blade axis 549 to articulate away from the nail driving axis 599, such as is shown in FIG. 3I.

This disclosure is not limited to the portion of the driver blade 54 which impacts the bumper 899. This disclosure is also not limited regarding the number of projections extending outward from the driver blade axis 549 toward one or more blade guides. In some embodiments, no projections are used.

In the example of FIG. 3, the return bumper system 900 is located distally from the nail stop 800, and is referred to as an upper bumper system having a first upper bumper 911 a second upper bumper 922. However, this disclosure is not limited as to any particular location of any of the bumper 899.

As shown in FIG. 3, the first driver blade ear 1100 can be guided by a first driver blade guide 2100 and the second driver blade ear 1200 can be guided by a second driver blade guide 2200.

FIGS. 3A-J illustrate an example of a nail driving and return cycle for an embodiment of a fastening tool having the driver blade 54 and using the driver blade stop 800. FIGS. 3A-J, specifically show an example of the movements of the driver blade 54, beginning with the driver at the home position (FIG. 3A), through driving a nail (FIGS. 3B, C and D), through the nail blade return phase (FIGS. E, F, G, H and I), and to the return of the driver blade 54 once again to its home position (FIG. J, and also FIG. A).

FIG. 3A illustrates a section showing the driver blade 54 at a rest position and/or home position. Herein, the terms "driver blade" and "driver profile" are used synonymously to encompass a nail driving member of the fastening tool. The terms "driver profile" and "driver blade" are used synonymously whether the driving member is made of one piece or multiple pieces. Multiple pieces of a "driver profile" and "driver blade" can be separate, integrated, move together or move separately. The driver blade 54 can be a single part made from a single material, such as a single investment cast steel part, or can be made of multiple parts and/or multiple materials.

In an embodiment, the driver blade 54 can be a single investment cast steel part. In an embodiment, the driver blade 54 can have an extruded shape forming an interface which mates with a flywheel 665 (FIG. 3C). As shown, the driver blade 54 can have a long slender nail contacting element 1001 integral with and/or attached to the driver blade, a driver blade tip portion 552, a driver blade tip 500, a driver blade tail portion 56 and a driver blade body 1000. In the embodiments of a cordless nailer shown herein, the driver blade 54 is shown as single investment cast steel part. In an embodiment, such as in cordless trim tools, the driver blade 54 can have separate parts that are assembled together. Herein, references to the driver blade 54 also are intended to encompass its portions and parts, such as the driver blade 54, the tip portion 552, or the driver blade tip 500.

One or more magnets, or mechanical catch systems, can be used to limit the rebound of the driver blade 54 during its return phase which occurs after driving a fastener into a workpiece.

FIG. 3A shows the driver blade 54 at a home position having the driver blade tip portion 552 arranged in contact with a home seat 760 of the home magnet holder 750. In an embodiment, a limit such as the home seat 760 on the magnetic holder 750 can be used to protect the magnet and/or to position the driver blade tip 500, or the tip portion 552, at a desired configuration.

In an embodiment, the driver blade stop 800 can stop the driver blade 54 without causing a concentration of wear and/or high stress on a portion of the driver blade body 1000, such as a tip portion 552, or the driver blade tip 500. In an embodiment, the driver blade tip 500 can have a 2 mm or greater overlap with a strike surface 810 of the driver blade stop 800, such as 2.5 or greater, or 3 mm or greater, or 4 mm or greater. In an embodiment, the home seat 760 can reversibly hold the driver blade in the home position.

Mechanical elements can also be used to align the driver blade 54 to strike the driver blade stop 800. In a non-limiting example, a hinged or spring loaded member can be used with, or instead of, a magnet to reversibly position the driver blade tip and/or the driver blade tip 500 in its home position. In another embodiment, a lifter spring can be used with, or without, a magnet. For example, a spring can be used to provide a force to move a portion of the driver blade, such as the tip portion 552, proximate to a home magnet 700. In another embodiment, a lifter spring can be used with or without the home magnet 700 to provide a force which moves a portion of the driver blade, such as the driver blade tip 500, to impact the driver blade stop 800.

FIG. 3A shows the driver blade 54 at a home position in which it is resting between driving cycles and/or awaiting being triggered to drive a nail. The driver blade body 1000 is shown in a resting state and not moving.

Herein, the term "home position" means the configuration in which the position of the driver blade is such that it is available to begin a fastener driving cycle. For example, as shown in FIG. 3A, the tip portion 552 of the driver blade 54 is proximate to the home magnet 700. In a "home position", the tip portion 552 and/or a portion of driver blade 54 is reversibly magnetically held by the home magnet 700. In an embodiment, the home magnet 700 can magnetically attract the tip portion 552 toward a home seat 760 against which the tip portion 552 can rest. In other embodiments, the home position can be configured such that the driver blade is affected by the magnetic force of the home magnet 700, but not held or in direct physical contact with the home magnet 700 itself, or the home magnet holder 750 home.

In an embodiment, the driver blade 54 can have a rest position which is the same position as the home position. Optionally, a portion of driver blade 54 can have contact with one or more of a bumper 899 when in the home state.

Herein, an articulation angle 719 (FIG. 3A) is the angle formed between a driver blade axis 549 and a drive path 399 and/or a nail driving axis 599 and/or the nail channel 352. The articulation angle 719 can be the angle at which the driver blade 54 and/or the driver blade axis 549 and/or the driver blade's longitudinal centerline and/or a driver blade's body articulates away from the nail driving axis 599. In an embodiment, in the home position, the driver blade 54 can strike the driver blade stop 800 at a first value of an articulation angle 719, as well as have a home position and/or rest at a different value of the articulation angle 719.

As shown in FIG. 3A, the driver blade can have a home position at an articulation angle 719 from the drive path 399 and/or nail driving axis 599 and/or nail channel 352. The articulation angle 719 can have a value sufficient to configure the tip portion 552 such that it is not aligned to strike any portion of the loaded nail 53. In an embodiment, the articulation angle 719 can be greater than 0.2° as measured from the driver blade axis 549 to nail driving axis 599. For example, the articulation angle 719 can be in a range of from 0.2° to 15°, or 0.2° to 5°, or 0.5° to 5°, or 0.2° to 3°, or 0.2° to 1°, or 0.5° to 1°, or 1° to 5°; such as 0.5°, or 0.8°, or 1°, or 2°, or 3°, or 5°, or 10° or greater. In an embodiment, the driver blade axis 549 can have an articulation angle 719 of 0.80° from the nail driving axis 599 when the driver blade 54 is in an at rest position.

In an embodiment, a dampening of the mechanical movement of the driver blade 54 can be achieved at least in part by articulating the driver blade out of the driving path during its return phase by impacting with an angled surface on the bumper 899. In an embodiment, the tip portion 552 can also be moved to a position out of the driving path by the home magnet 700, which magnetically attracts the driver blade 54. During the return phase, as the driver blade rebounds off the bumpers 899 and toward the next nail to be fired, the driver blade stop 800 can be used to limit the advance of the driver blade toward the nosepiece assembly 12 and/or the loaded nail 53. This can prevent the driver blade 54 from rebounding into the driving path to hit and potentially drive and/or dislodge a next nail.

In an embodiment, the driver blade 54 can be intentionally displaced from the drive path to a position which prevents or inhibits the driver blade 54 from undesirably and unintentionally moving along the nail driving axis 599 toward a fastener, such as nail 53. This intentional displacement can prevent improper driving and/or unintended contact with the nail, which was not intended to be driven. As an additional benefit is obtained in that when the driver blade 54 for a nailer is displaced from the drive path unintended contact and/or the duration of contact with the flywheel 665 and driving mechanism is reduced resulting in a quiet flywheel-based tool. As shown in FIG. 3A, the tip portion 552 can rest at a distance of a blade stop gap 803 (FIG. 10) from the driver blade stop 800 and the driver blade tip 500. In an embodiment, when in the home position, a blade stop gap 803 (FIG. 10) can be present between the driver blade stop 800 and the strike surface 810 of tip portion 552. In an embodiment, the driver blade stop 800 can be in a range of from 1 mm to 25 mm, 2 mm to 10 mm, or 3 mm to 10 mm, or 4 mm to 8 mm, or 2 mm to 5 mm; such as 1.5 mm, 2 mm, 2.5 mm, 3 mm, 3.5 mm, 4 mm, 5 mm, 8 mm, or greater.

In an embodiment, a blade stop gap 803 distance of 8 mm or greater can be used and can prevent the driver blade tip 500 from wearing off, become misshaped, damaged or rounded.

Increasing the distance between the driver blade stop 800 and a return bumper system 900 can increase the operating life of the driver blade stop 800, as well as the driver blade 54. In a non-limiting example, positioning the driver blade stop 800 at a distance from the bumper 899 or the return bumper system 900 causes the driver blade 54 to expend its return energy during the return phase traveling between the bumper 899 and the driver blade stop 800. This reduction in energy reduces the wear rate of the driver blade stop 800 and driver blade tip 500. For example, if the driver blade stop 800 was too close to the upper bumpers the driver blade 54 would impact the driver blade stop 800 with more energy causing additional wear to both the driver blade stop 800 and the driver blade 54.

FIG. 3A also shows the tail portion 56 of driver blade 54. In an embodiment, the tail portion 56 can be a portion of the driver blade body 1000. The driver blade body 1000 can have portions that are used to guide and/or control the movement of the driver blade 54, as well as portions that can be used to control the driver blade 54 during its return phase. A contact of a portion of the driver blade 54, such as the tail portion 56 with the bumper 899, such as a first bumper 910 and/or a second bumper 920, when the driver blade 54 is in a home position is optional.

FIG. 3A shows a return bumper system 900 which can have one or more of the bumper 899. The second bumper 920 is shown which is configured to be the second upper bumper 922 having the second bump surface 972.

The bumper 899, such as first bumper 910 and/or second bumper 920, can be made from a material having a polymer, a rubber, a plastic, a Sorbathane® (by Sorbothane, Inc., 2144 State Route 59, Kent, Ohio 44240, (330) 678-9444; or by Sorbo Inc., 1067 Enterprise Pkwy, Twinsburg, Ohio 44087), a synthetic viscoelastic urethane polymer, a synthetic viscoelastic polymer, a polymer, a foam, a memory foam, a gel, a thermoset plastic, PVC, natural rubber, synthetic rubber, closed cell foam, sorbathanes, urethanes, urethane rubber, urethane material, resin, cured resin, multiphase material, reinforced material, or fiber reinforced material.

The bumper 899 can have a bumper height 1979 (FIG. 11) in a range of greater than 2 mm, such as in a range of from 2 to 25 mm, or 3 mm to 15 mm, or 5 to 10 mm, such as 3 mm, or 5 mm, or 10 mm, or 20 mm. The bumper 899 can have a bumper width 1978 (FIG. 11) in a range of from 5 to 30 mm, or 5 mm to 25 mm, or 5 to 20 mm, or 10 mm to 20 mm; such as 5 mm, or 10 mm, or 15 mm, or 20 mm. The bumper 899 can have a bumper depth 1976 (FIG. 3) in a range of from 2 to 25 mm, or 3 mm to 15 mm, or 5 to 10 mm, such as 3 mm, or 5 mm, or 10 mm, or 20 mm.

The bumper can have a bumper density in a range of from 0.50 g/cm^3 to 10.0 g/cm^3, or from 0.50 g/cm^3 to 1.0 g/cm^3, or 0.50 g/cm^3 to 2.0 g/cm^3, or 0.50 g/cm^3 to 5.0 g/cm^3, or 0.50 g/cm^3 to 2.0 g/cm^3; such as 1.0 g/cm^3, or 2.0 g/cm^3, or 3.0 g/cm^3, or 4.0 g/cm^3, or 5 g/cm^3.

FIG. 3B shows the driver blade 54 aligned to drive a nail. As shown in FIG. 3B, a movable member, such as a pinch roller 655, exerts a force upon at least a portion of the driver blade 54 moving the driver blade axis 549 into alignment to position driver blade 54 to drive a nail into a workpiece.

In an embodiment, a pinch roller 655 can exert an alignment force 657 against a portion of the driver blade body 1000. The alignment force 657 can overcome the attractive force of the home magnet 700 and pivot the driver blade axis 549 to align and/or be configured collinearly with the nail driving axis 599 and with the drive path 399. The example of FIG. 3B shows, by alignment arrow 1657, the pivoting of the driver blade axis 549 to be aligned and/or be configured collinearly with the nail driving axis 599.

FIG. 3C shows the driver blade 54 being driven and in contact with the head of a nail 53. In FIG. 3C, a flywheel 665, which rotates as shown by the directional arrow 1665, is shown in reversible and temporary frictional contact with and driving the driver blade 54. The temporary contact by flywheel 665 to the driver blade 54, imparts energy to the driver blade 54 to move in the direction of driving arrow 1054 and to drive a nail 53. FIG. 3C shows the driver blade tip 500 in contact with a nail head 592 of the loaded nail 53.

In an embodiment, a fastening tool can have a high power flywheel 665 as defined below. In a high power flywheel design, the driver blade 54 can be driven by a flywheel 665 which can have a significant mass and can have significant momentum when rotating. The momentum and/or kinetic energy present in the driver blade 54 can be significant even after a driving of a nail has occurred. Residual kinetic energy present in the driver blade 54 can be high after the driving of a nail into a soft material, or after driving a short nail. In another example, a very small nail driven into a very soft workpiece can result in a very high residual energy in the driver blade 54. This can result in the driver blade 54 having a high momentum at the end of the return stroke when it can impact the bumper 899.

In an embodiment, the flywheel for a nailer 1, such as a framing nailer, when used for wood nailing can rotate at a high power, such as a value of from 10000 rpm to 15000 rpm, or 12000 rpm to 15000 rpm, or about 13000 rpm and can have an inertia in a range of from 0.000010 kg to m/s^2 to 0.000030 kg-m/s^2, or 0.000020 kg to m/s^2 to 0.000025, such as or 0.000015 kg-m/s^2, or 0.000022 kg-m/s^2, or 0.000024 kg-m/s^2. In an embodiment, the driver blade 54 velocity for a nailer for wood of 40 ft/s to 100 ft/s, or 50 ft/s to 90 ft/s, or 60 ft/s to 80 ft/s; such as 65 ft/s, or 70 ft/s, or 75 ft/s, or 80 ft/s. In an embodiment, the nailer 1 can have the depth adjustment wheel 340 set the depth adjust set for a depth for nailing of 2 inch smooth shank nails into soft wood, such as spruce, pine, and fur lumber, or plywood sheathing and/or plywood sheeting.

In another embodiment, the flywheel can be used in a fastening tool to drive fasteners into concrete, steel or metal. Such tools include but are not limited to nailers, concrete nailers and rivoters. To drive fasteners into hard and dense materials, such as concrete and metals, the flywheel 665 can spin at a value of from 12000 rpm to 20000 rpm, or 13000 rpm to 16000 rpm. The flywheel 665, when used in a nailer for concrete and/or steel and/or metal, can have an inertia in a range 0.000020 kg-m/s^2 to 0.000040 kg-m/s^2. In an embodiment, the driver blade 54 can have a driving velocity for a nailer and/or for concrete nailer and/or steel and/or metal can be from 70 ft/s to 135 ft/s, or 75 ft/s to 120 ft/s or 80 ft/s to 90 ft/s or driving ½" nails and/or into structural steel and/or concrete. In an embodiment, the driver blade 54 can use driver speeds of about 120 ft/s and store 75-110 J in the driver blade 54 and/or driver assembly.

In an embodiment, the nailer driver blade stop 800 can be used in a nailer that drives a nail into any of a broad variety of materials, such as but not limited to steel, drywall track, or mechanical mounting hardware. In one example, workpieces can be used which have metal thicknesses of from 0.001 mm to 2 mm, or 0.01 mm to 10 mm, or from 1.0 mm to 5 mm, or 0.5 mm to 4 mm, or 1.5 mm to 2 mm, or 1.75 mm to 3 mm. Fastening tools using the driver blade stop 800 can drive fasteners into structural steel, in a non-limiting example, structural steels having a hardness below HRC 20.

FIG. 3D shows the driver blade 54 in the process of driving the loaded nail 53 driving a nail into a workpiece. In FIG. 3D, the driver blade 54 and the tip portion 552 have advanced along the nail driving axis 599 and along the drive path 399 such that the tip portion 552 has passed into the nail channel 352 to drive the loaded nail 53. The direction of movement of the driver blade 54 is shown by driving arrow 1054.

FIG. 3E shows the driver blade 54 beginning the return phase, which can begin the moment a fastener has been driven. FIG. 3E depicts a moment at which, the loaded nail 53 has been driven into the workpiece, the flywheel 665 has been retracted and the return path 1222 is free of obstacles along its length to allow the return of the driver blade 54. In an embodiment, the return path can be the pathway which will be taken by the movement of the tail portion 56 from the moment a drive is complete until it impacts the bumper 899 and/or another return stop member. Recoil arrow 1056 shows the change in direction from when the driver blade 54 transitions from the direction indicated by driving arrow 1054 to the direction indicated by a return arrow 1058.

The driver blade stop 800 disclosed herein allows for operation of a power tool, such as the nailer 1, using higher driver speeds. In an embodiment, the driver blade stop 800 can be used at high return speeds of the driver blade 54, for example up to 200 ft/s, while reducing or preventing bounceback. This reducing or preventing bounceback can reduce or eliminate misfire or the breaking of the collation of a nail from other collated nails when no driving event was yet intended for such collated fastener. In an embodiment, driver blade speeds during a driving action can be in a range of from 25 ft/s to 200 ft/s, or 30 ft/s to 200 ft/s, or 40 ft/s to 200 ft/s, or 50 ft/s to 200 ft/s, or 50 ft/s to 150 ft/s, or 75 ft/s to 150 ft/s, or 50 ft/s to 125 ft/s, or 75 ft/s to 100 ft/s; such as 40 ft/s, or 50 ft/s, or 60 ft/s, or 75 ft/s, or 80 ft/s, or 90 ft/s, or 100 ft/s, or 105 ft/s, or 106 ft/s, or 110 ft/s, or 115 ft/sec, or 125 ft/s, or 150 ft/s, or 200 ft/s.

In an embodiment, the driver blade stop 800 can be used in high energy fastening tools that have an elastic-type return system, such as in a concrete nailer. In an embodiment, the driver blade stop 800 can be used in a nailer that generates a driving pressure from 75 PSI to at least 10,000 PSI, or 1000 PSI to 20,000. For example, the driving pressure can be in a range of from 1,000 PSI to 15,000 PSI, or 1,000 PSI to 14,000 PSI, or 1,000 PSI to 13,000 PSI, or 4,000 PSI to 13,000 PSI, or 5000 PSI to 15,000 PSI, or 6000 PSI to 13,000 PSI, or 5,000 PSI to 9,000 PSI, or 6,000 PSI to 8,000 PSI, or 7000 PSI to 8,000 PSI, or 10,000 PSI to 15,000 PSI, or 12,000 PSI to 14,000 PSI, or 12,500 PSI to 13,500 PSI, or 11,000 PSI to 15,000 PSI. Further, a nailer can have a driving pressure of 5,000 PSI, or 7,500 PSI, or 10,000 PSI, or 13,000 PSI, or 15,000 PSI or 18,000 PSI.

In embodiments, misfires can occur when the residual momentum or energy causes the driver blade to impact a bumper or driver blade stop 800 after driving the loaded nail 53. The residual momentum of the driver blade 54 after striking the bumper or driver blade stop 800 can cause the driver blade 54 to continue back down the nail channel 352 toward a next nail. In embodiments, the driver blade can have enough residual energy after driving a fastener, such as a nail, to return against a bumper and/or stop and then undesirably rebound to dislodge a next nail of a nail stick, which breaks the next nail's collation with other nails and pushes that next nail down the driving chamber, although not always expelling it from the tool. Such a misfire can, or improper driving of the driver blade 54, can lead to jams, bent nails and damage to the fastening tool.

Another type of misfire can result when an uncontrolled return of the driver blade 54 causes a misalignment of nails, or a partial broken collation, or a broken collation which leave an improperly aligned nail in the nail channel 352. Under such circumstances, when the tool is next triggered two nails can be driven at the same time causing misfire. For example, if a first nail has been pushed down the nail channel 352 and the head of a next nail is exposed, then a misfire can occur, then the driver blade can strike the next nail head and both nails are improperly driven. The embodiments disclosed herein solve this problem.

To reduce or prevent misfire, the driver blade 54 recoil movements can be dampened and/or controlled by using a magnetic catch, a bumper, an isolator and/or a dampener material to dissipate momentum. In an embodiment, a mechanical stop can be used to receive a driver blade impact after it returns and bounces off one or more bumpers, or other object. The driver blade stop can act as a mechanical beat piece and/or piece to receive impacts from the driver blade 54. In an embodiment, the driver blade stop 800 can be hardened investment cast steel. In an embodiment, the home magnet 700 having an attractive force upon the driver blade 54 can be used alone, or in combination with an angled upper bumper to attract the driver blade tip 500 into the driver blade stop area and force it to impact in the driver blade stop which limits bounce-back, movement into the drive path to hit another nail and the recoil of the driver blade 54. In an embodiment, the home magnet 700 holder can limit the vertical displacement and the area of the driver blade tip 500 which impacts the mechanical stop.

The speed of the driver blade upon its return is referred to herein as a return speed. The return speed can vary depending upon the driver blade 54, as well as the workpiece into which the fastener is driven. When a fastener is driven without misfire, the return speed can be in a range of 10 ft/s to 150 ft/s, or 10 ft/s to 100 ft/s, or 15 ft/s to 75 ft/s, or 15 ft/s to 50 ft/s, or 20 ft/s to 50 ft/s, or 20 ft/s to 40 ft/s, or 20 ft/s to 35 ft/s, or 25 ft/s to 30 ft/s; such as 90 ft/s, or 100 ft/s, or 105 ft/s, or 106 ft/s, or 110 ft/s, or 115 ft/sec, or 125 ft/s.

Misfire conditions can result in a return speed in a range of from 50 ft/s to 200 ft/s, or 50 ft/s to 110 ft/s, or 75 ft/s to 106 ft/s, or 75 ft/s to 105 ft/s, or 75 ft/s to 100 ft/s, or 50 ft/s to 80 ft/s; such as 125 ft/s, or 120 ft/s, or 110 ft/s, or 106 ft/s, or 105 ft/s, or 100 ft/s, or 90 ft/s, or 80 ft/s, or 75 ft/s, or 50 ft/s.

FIG. 3F shows the driver blade 54 making contact with the bumper 899. FIG. 3F shows the return of the driver blade 54 in the direction of the return arrow 1058. FIG. 3F shows this return motion at the moment where the second pivot surface 1520 of pivot portion 1499 has just made a contact with a portion of the bumper 899, such as the second bumper 922. The second bumper 922 can have a second pivot point 996 which in the example of FIG. 3F is the first portion of the second bumper 922 to be contacted by the second pivot surface 1520 of pivot portion 1499.

FIG. 3F shows the driver blade axis 549 still aligned and/or still configured collinearly with the nail driving axis 599 and in alignment with the drive path 399.

At this point in the return phase, after the loaded nail 53 has been driven and the return of the driver blade 54 has cleared the tip portion 552 from the nail channel 352, the next nail 554 is advanced into the nail channel 352 for driving by the driver blade 54.

FIG. 3G shows the driver blade 54 during the return phase pivoting into alignment to strike the driver blade stop 800. The contact of the tail portion 56 with the bumper can cause a pivoting of the orientation of the driver blade 54 which prevents the driver blade 54 from rebounding to strike the next nail head 556 and prevents the tool from misfiring. The pivoting motion is shown by pivot arrow 1970.

By removing the tip portion 552 from the drive path 399 during the return phase, the driver blade 54, the tip portion 552 and the driver blade tip 500 are prevented from contact with any portion of the next nail 554, such as the next nail head 556.

In the example embodiment of FIG. 3G, the second bumper 922 has a second pivot surface 1520 which is at an angle to, not parallel to and not coplanar with, the pivot surface 1500, such as the second pivot surface 1520. The second bumper causes the driver blade 54 to pivot away from the nail driving axis 599. The action of the second pivot surface 1520 of pivot portion 1499 against the driver blade 54 moves the driver blade axis 549 out of alignment with the nail driving axis 599 and the drive path 399. The pivoting of the driver blade 54 configures the driver blade axis 549 to have an angle greater than zero (0°) with the nail driving axis 599 and the drive path 399. The pivoting of the driver blade 54 configures the driver blade axis 549 such that the driver blade 54 is not collinear, or coplanar, with the nail driving axis 599 and the drive path 399.

FIG. 3G shows the measure of the displacement of the driver blade 54 from the nail driving axis 599 and/or the drive path 399 as an articulation angle 719. In an embodiment, the articulation angle 719 can be in a range of from 1° to 25°, or 1° to 15°, or 1° to 10°, or 1° to 5°; such as 1°, or 2°, or 3°, or 4°, or 5°, or 10°, or 15°.

The articulation angle 719 can align a portion of the driver blade 54, such as the tip portion 552 to contact a stop member, such as blade stop 800. FIG. 3G shows the articulation angle 719 aligning the driver blade axis 549 such that the tip portion 552 will strike the driver blade stop 800. When the driver blade axis 549 is configured to direct the contact of the tip portion 552, the contact of the tip portion 552 with the driver blade stop 800 can dissipate the energy of the driver blade 54 during the return phase, as well as physically preventing the tip portion 552 from moving along the nail driving axis 599 or the drive path 399, and preventing a misfire.

In an embodiment, at least a portion of the driver blade 54 can contact the bumper 899 and/or the blade stop 800 a number of times. Repetitive contact of the driver blade between the bumper 899 and the driver blade stop 800 can prevent misfire under conditions in which the driver blade 54 has a high mechanical energy after a fastener, such as a concrete nail is driven.

In an embodiment, an impact of a portion of a driver blade upon the bumper 899 can cause a deformation of the bumper 899 which can be temporary and/or reversible. In an embodiment, the bumper 899 can be resilient and can maintain its mass after repeated impact of a portion of the driver blade 54. Herein, the term deformation period is the period of time during which a resilient embodiment or memory embodiment of the bumper 899 is deformed prior to return to its shape prior to impact, or approximately to its shape prior to impact, or near to its shape prior to impact. In an embodiment, the bumper 899 can have a deformation time in a range of from 0.5 ms (0.0005 s) to 1000 ms (10 s), or 1 ms (0.001 s) to 500 ms (0.5 s), or 1 ms (0.001 s) to 50 ms (0.05 s), or 0.5 ms (0.0005 s) to 4 ms (0.004 s), or 1 ms (0.001 s) to 3 ms (0.003 s), or 0.5 ms (0.0005 s) to 2 ms (0.002 s), or 1 ms (0.001 s) to 2 ms (0.002 s). In an embodiment, the bumper 899 can have a deformation time which is 1000 ms or less, or 750 ms or less, or 500 ms or less, or 400 ms or less, or 300 ms or less, or 250 ms or less, or 200 ms or less, or 100 ms or less, or 75 ms or less, or 50 ms or less, or 40 ms or less, or 30 ms or less, or 25 ms or less, or 20 ms or less, or 10 ms or less, or 1 ms or less. For example the bumper 899 can have a deformation period of less than 5 seconds, such as 4 s, or 3 s, or 2 s, or 1 s, or 0.75 s, or 0.5 s, or 0.25 s, or 0.2 s, or 0.1 s, or 0.05 s.

In an embodiment, the deformation period can be equal to or near zero (0) seconds and the impact can be elastic or near elastic. In another embodiment, the deformation period can be highly elastic. In an embodiment, the deformation period can be a function of the return velocity. For example at a higher velocity the upper bumper can exhibit a greater deformation period. In an embodiment, the deformation period of the upper bumper is less than a bump cycle time. A bump cycle time is the time required in bump mode for an operator to drive a nail and then bump motion to trigger the nailer to engage the driver blade to drive the bump triggered fastener. In an embodiment, the deformation period of the upper bumper is less than a triggering time of the fastening tool, such as a nailer. In an embodiment, the trigger time of a nailer is the time required for an operator to pull the trigger and for the nailer to engage the driver blade to drive a fastener.

In an embodiment, the bumper 899 can have an operating life of 50,000 to 150,000 return phases and/or impacts from the driver blade. For example, the bumper 899 can have an operating life of 50,000 or greater return phases, 65,000 or greater return phases, or 75,000 or greater return phases, or 100,000 or greater return phases, 125,000 or greater return phases.

FIG. 3H shows the moment in the return phase when the driver blade tip 500 is striking the driver blade stop 800 and the driver blade tip 500 of the tip portion 552 is striking the strike surface 810 of the driver blade stop 800. FIG. 3H shows the driver blade 54 configured to have the driver blade axis 549 positioned at the articulation angle 719 from the nail driving axis 599 and/or the drive path 399. In FIG. 3H, the articulation angle 719 aligns and/or configures the driver blade axis 549 such that at least a portion of the driver blade 54, such as the tip portion 552, will strike the driver blade stop 800 when moving in a strike direction shown by strike arrow 1810.

FIG. 3I shows the driver blade 54 seated in its home position against the home seat 760 after having struck the strike surface 810 of the driver blade stop 800 and at least a portion of driver blade 54 being magnetically attracted by home magnet 700. In an embodiment, after striking the driver blade tip 500 against the strike surface 810, the driver blade 54 can still have a kinetic energy and have a motion away from the strike surface 810. While the driver blade 54 moves away from the strike surface 810, the magnetic attraction from home magnet 700 of at least a portion of the driver blade 54, can dampen and/or stop further motion of the tip portion 552 away from the strike surface 810. In an embodiment, the magnetic attraction of the tip portion 552 by the home magnet 700 can dampen and overcome the kinetic energy retained by the driver blade 54, can pull the tip portion 552 toward and frictionally against the home seat 760 and can stop further axial movement of the driver blade 54. The magnetic influence pulling the tip portion 552 toward and frictionally against the home seat 760 can dampen and/or stop the movement of the driver blade 54 and bringing the driver blade 54 to a rest state in a home position.

As shown in FIG. 3I, the driver blade axis 549 can be displaced by the articulation angle 719 by a pivot resulting from a portion of the driver blade 54 with the bumper 899. The articulation angle 719 can cause the driver blade axis 549 to be oriented such that the tip portion 522 can strike the driver blade stop 800. After the driver blade 54 strikes the driver blade stop 800, the driver blade axis 549 can remain oriented along the displacement axis 779, or can vary from being collinear with that axis. The magnetic force from the home magnet 700 can pull the driver blade 54 such that when the tip portion 552 is resting against the home seat 760, the driver blade axis 549 is aligned with a home axis 799.

FIG. 3I also shows the direction of movement of the driver blade axis 549 from the displacement axis 779 toward the home axis 799 by home arrow 1760. While FIG. 3I shows the movement of the driver blade axis 549 from the displacement axis 779 toward the home axis 799, such movement is only one of a number of movements by which the tip portion 552 of the driver blade 54 will be magnetically pulled into a home position. When the tip portion 552 strikes the driver blade stop 800, the recoil of that impact can vary based upon factors such as driver blade speed, the kinetic energy of the driver blade, the orientation of the tool, the movement of the tool and other factors. The home magnet 700 can have a strong enough attraction to pull the tip portion 552 into a home position under a broad variety of operation conditions.

In the embodiment of FIG. 3I, a home angle 717 is shown as an instance of the articulation angle 719 when the driver blade 54 is at a home position. In this example, the home angle 717 can result from a first articulation of the driver blade 54 which aligns the driver blade axis 549 to strike the driver blade stop 800 and forms a strike angle 729, and a second articulation happens after the driver blade tip 500 strikes the driver blade stop 800. The second articulation is the articulation which aligns the driver blade axis 549 in a home position forming a dampening angle 739. In the example of FIG. 3I, home angle 717 results from the sum of the strike angle 729 and the dampening angle 739. This is exemplary of a two-step radial movement of the driver blade axis 549 into a home position. The movement of the driver blade axis 549 can be varied and chaotic upon impact with the driver blade stop 800. Other angular sums and dampening behaviors can also result in a variety of articulation angles occurring or existing during the striking and magnetic dampening process. This disclosure is not intended to be limited in this regard.

This disclosure also does not limit the number, type, or configuration of any magnet or magnets which can be used. This disclosure also does not limit the placement and orientation of one or more magnets used to control the movement of the driver blade 54 during the return phase and to attract the driver blade to have a home configuration. In an embodiment, the magnet is a neodymium, ferrite, or sintered NdFeB magnet having a force in a range of from 0.5 lbf to 5 lbf, such as 1 lbf, or 2 lbf or 3 lbf, or 4 lbf. In an embodiment, the magnet can be a sintered NdFeB magnet having dimensions of 8 mm×12 mm×5 mm.

Figure 3J:
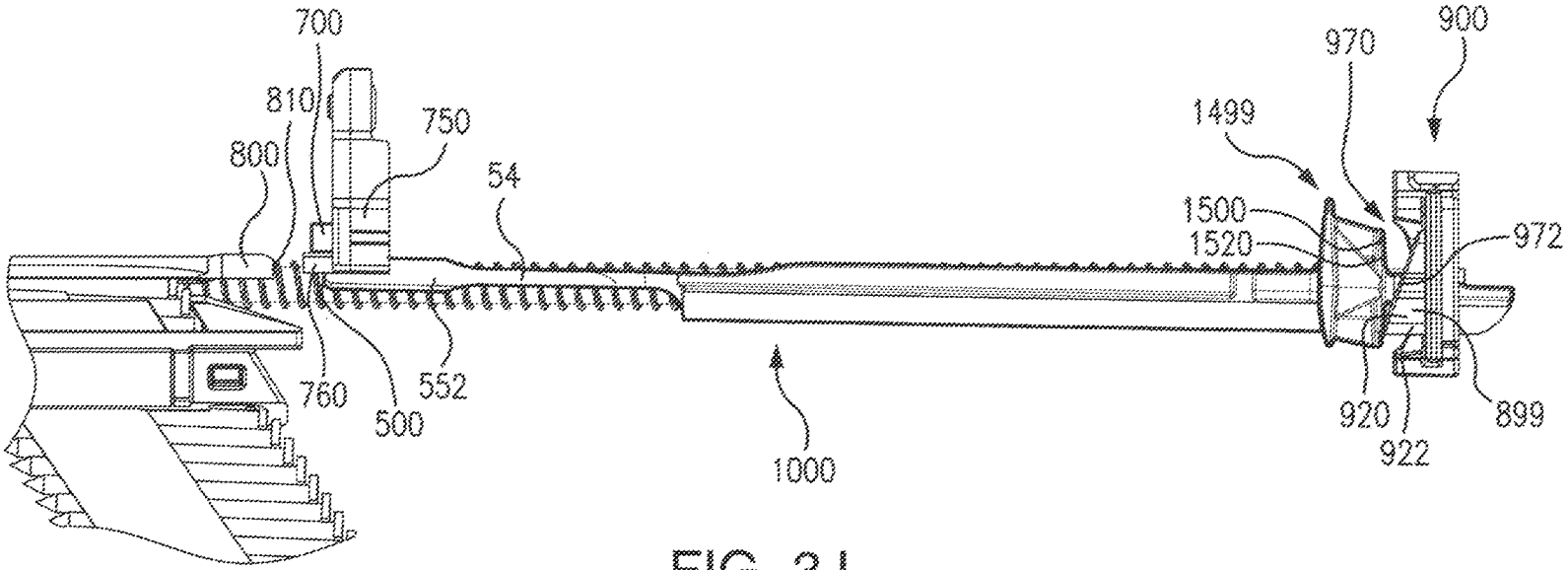
FIG. 3J shows a driver blade at rest in its home position.

As depicted in FIG. 3A, FIG. 3J shows the driver blade 54 at rest in its home position waiting for the triggering of another nail driving cycle.

Figure 4:
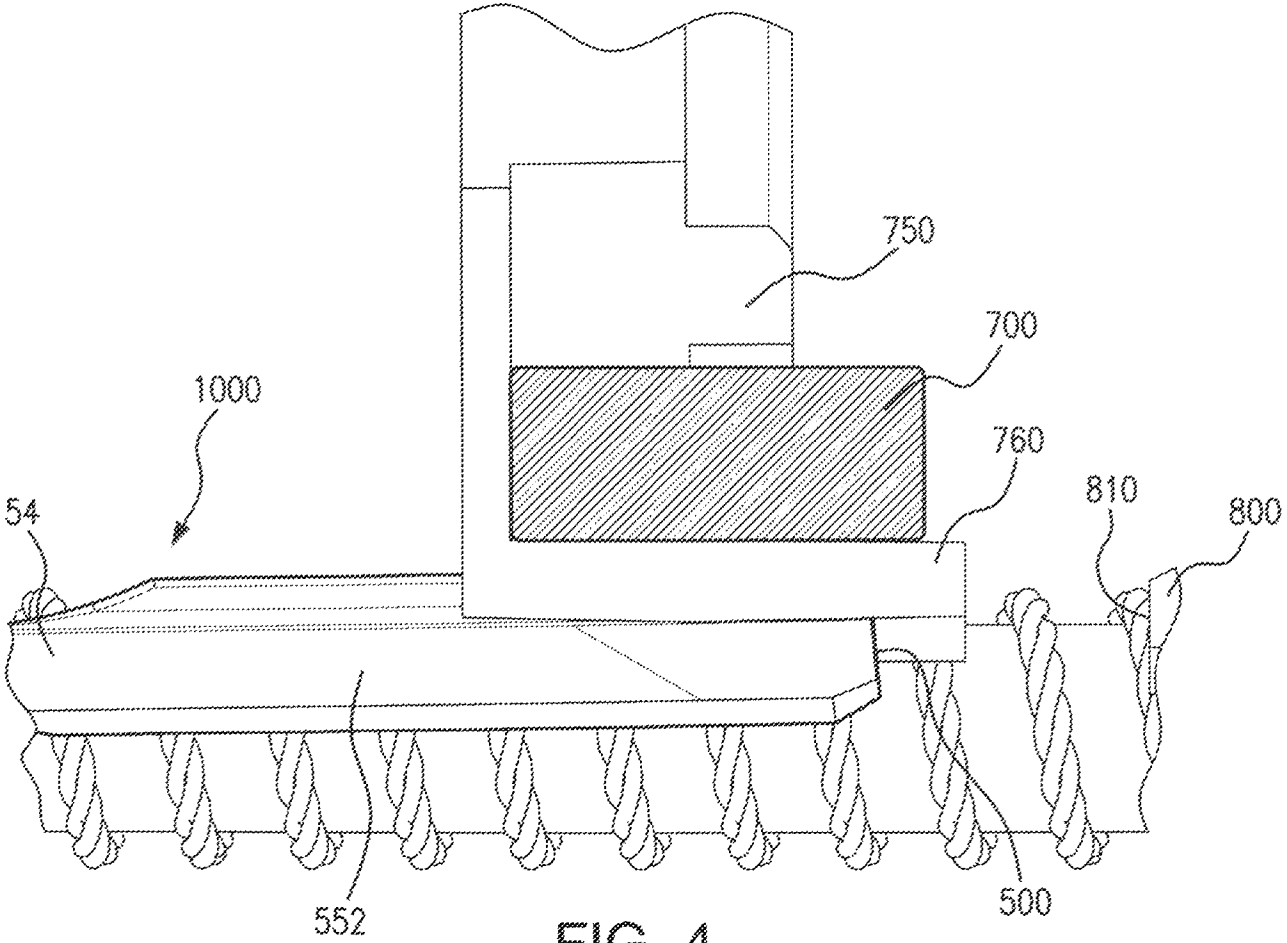
FIG. 4 is a cross sectional view of a rebound control mechanism.

FIG. 4 is a cross-sectional view of a rebound control mechanism. FIG. 4 shows a close up view of the driver blade tip 500 contacting the strike surface 810. In an embodiment, the driver strike surface 810 can limit the travel of the driver blade 54 in the nail driving direction, along the nail driving axis. Overlap of the driver strike surface 810 by a portion of the driver blade tip 500 is illustrated. In the embodiment of FIG. 4, the home magnet holder 750 can be used to separate the home magnet 700 from the driver blade tip 500. The thickness and positioning of the home magnet holder 750 can be used to control the force holding the driver blade in the home position.

Figure 5:
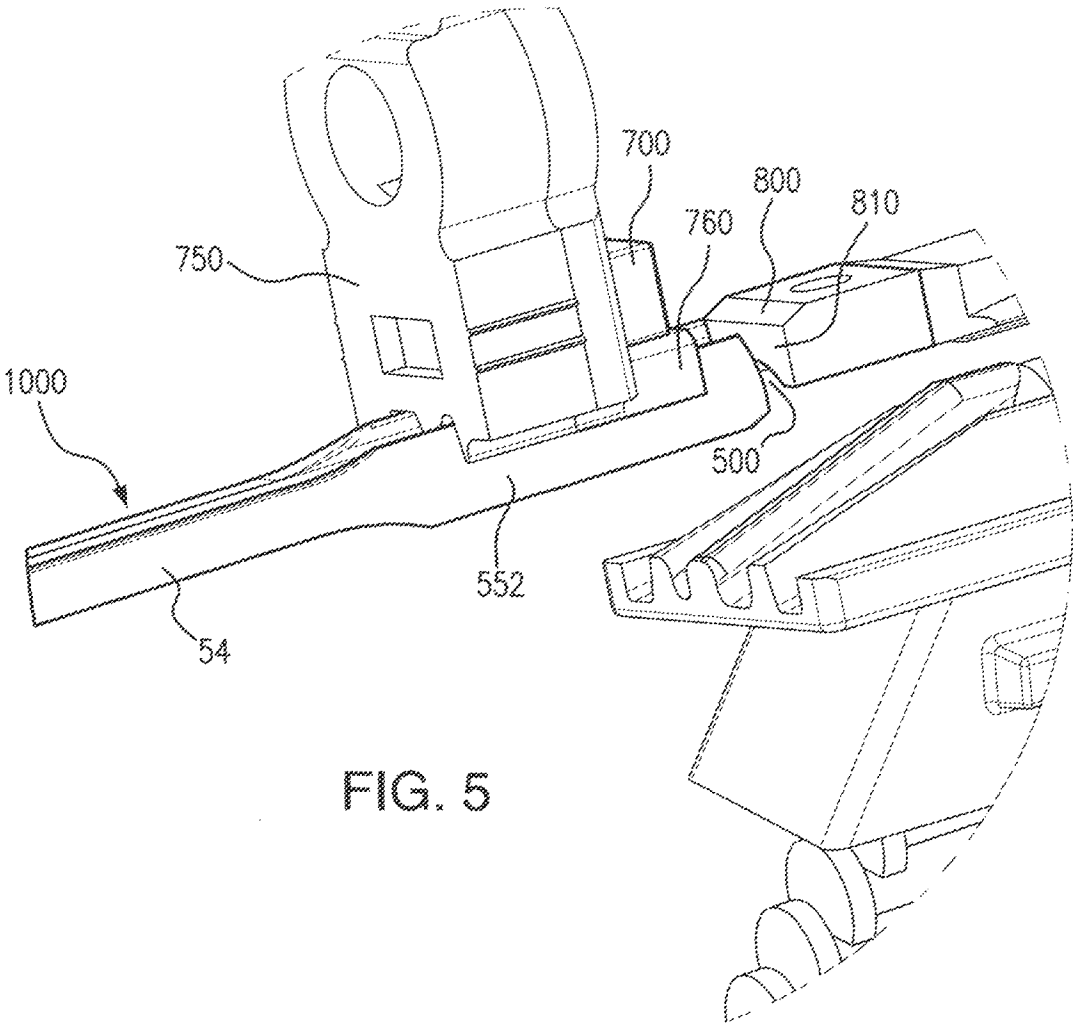
FIG. 5 is a detailed view of the home magnet which can interact with the driver blade tip.

FIG. 5 is a detailed view of the home magnet 700 which can magnetically attract the tip portion 552. In an embodiment, plastic or aluminum can be used to mount the home magnet 700 and can be used to make the home magnet holder 750.

Figure 6:
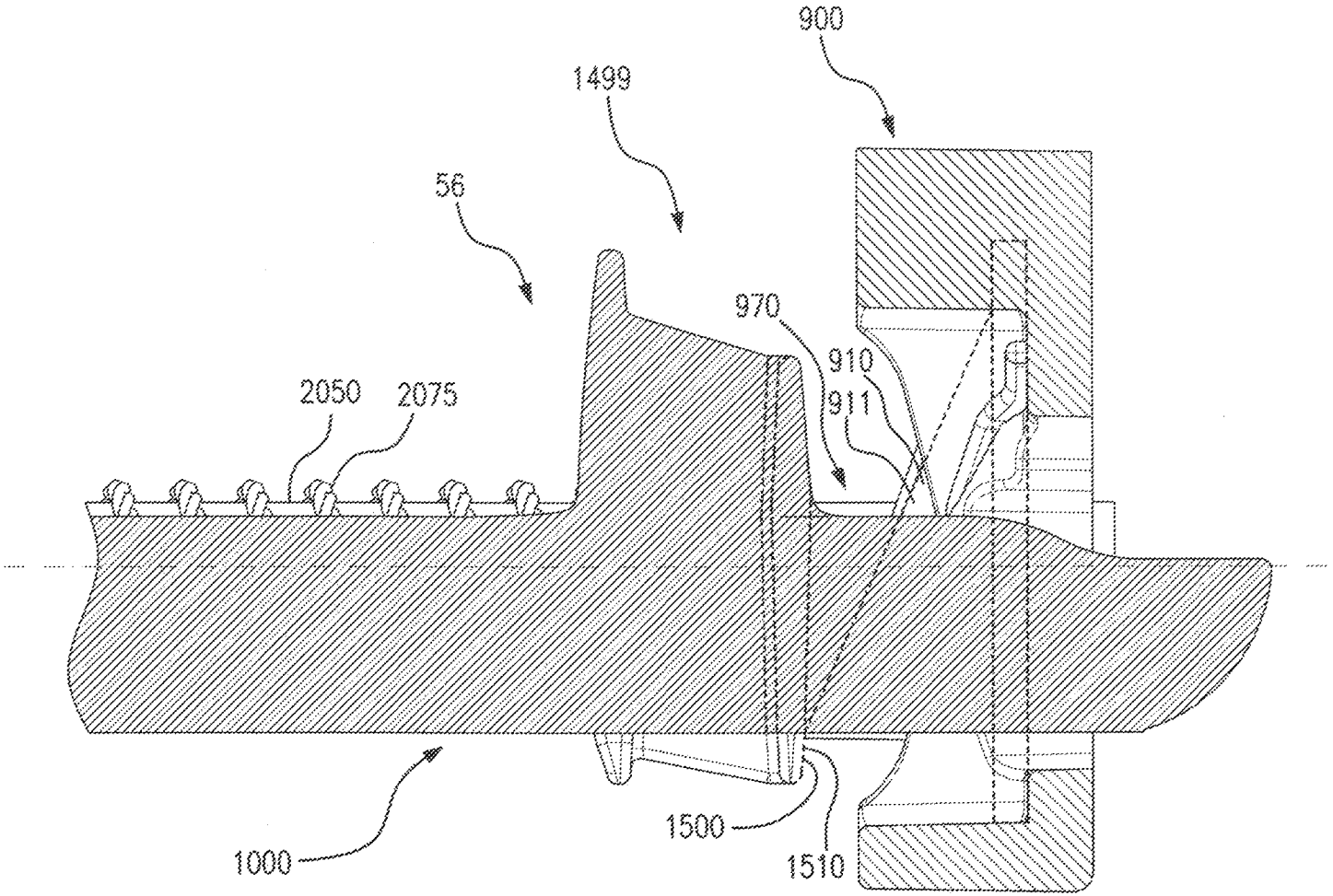
FIG. 6 is a close up view of an angled upper bumper.

FIG. 6 is a close up view of an embodiment having one or more angled bumper 899. In the embodiment of FIG. 6, one or more of the bumper 899 having an angled shape can be used for impact by a driver blade ear 1100 and 1200 (FIG. 3) and the bumper 899 with an angled shape can absorb energy and articulate the driver blade tip 500. In the embodiment of FIG. 6, during the return stroke of the driver blade 54 after driving a nail 53, a blade guide 2050 can guide the driver blade into the one or more of the bumper 899 on the return stroke. In an embodiment, a blade guide 2050 can be used in conjunction with a return spring 2075 which can optionally be coaxial to the blade guide 2050 or otherwise located to dampen the energy of the return stroke. Optionally, the return rail can be made of steel or other metal.

In an embodiment, the driver blade can have one or more projecting portions, which can be referred to as one or more of an "ear". In an embodiment, the driver blade can have one or more ears which can impact one or more of the upper bumper during a rebound motion and can upon contact with the one or more of the bumper 899 and can move the driver blade axis 549 such that the driver blade axis 549 is not collinear with the driving axis 599. This disclosure is not limited to the location of the one or more of the bumper 899. This disclosure is also not limited regarding the one or more portions of the driver blade which can contact the one or more of the bumper 899.

Figure 7:
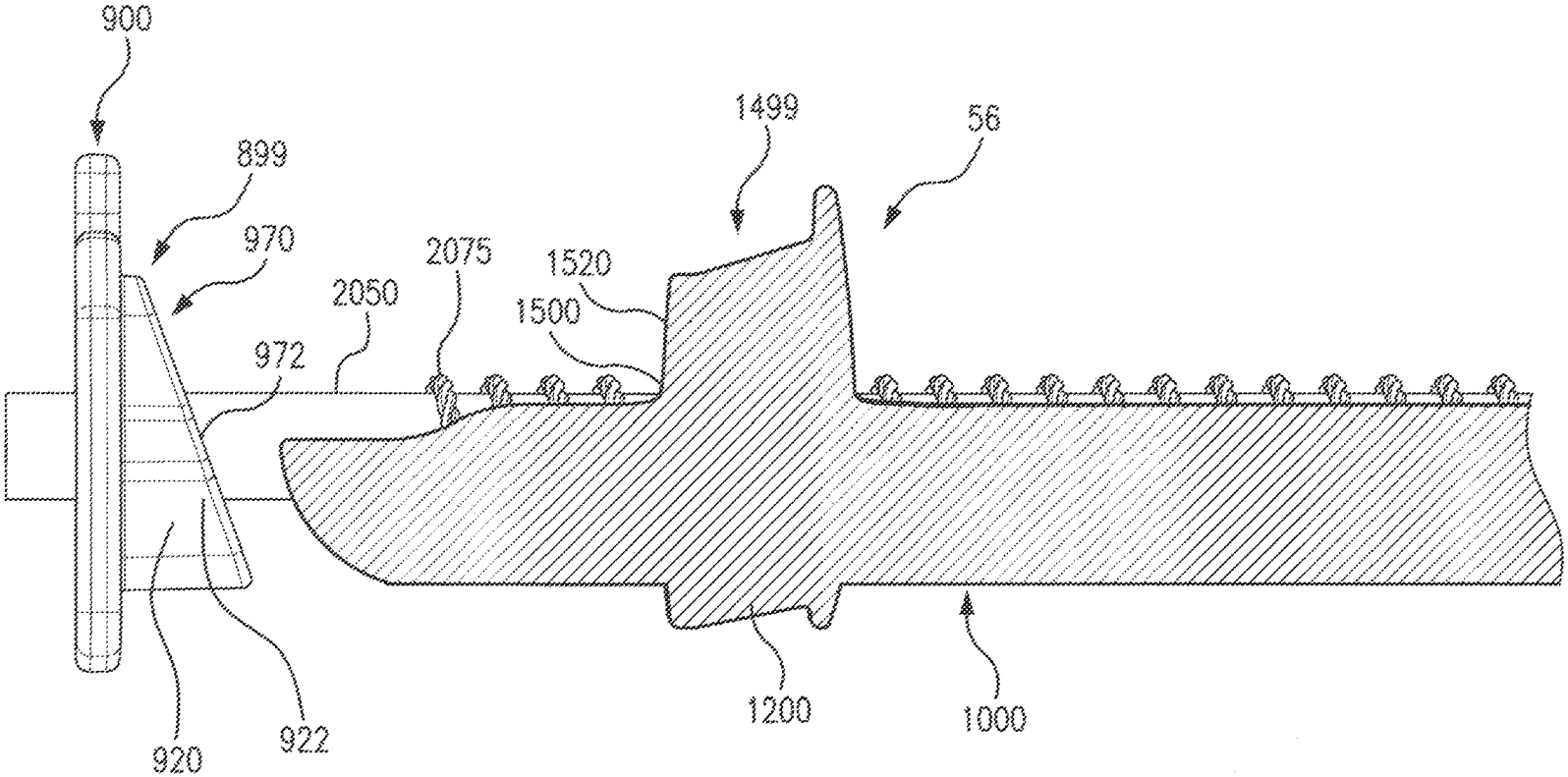
FIG. 7 is a detailed view of a driver blade ear which can impact an angled surface of an upper bumper.

FIG. 7 is a detailed view of a section of driver blade 54 having the second driver blade ear 1200 which can impact the second bump surface 922 of the second bumper 920 which is at an angle from the second pivot surface 1520. Contact by the second driver blade ear 1200 with the second bump surface 922 at a pivot angle (FIG. 11) can force the driver blade tip 500 to articulate away from the nail driving axis 599. The bumper 899 and/or the driver blade 54 can have one or a number of angled contact surfaces.

In an embodiment, a bumper angle 973 (FIG. 11) of the bumper 899 can cause the tip 500 of the driver blade to radially move away from the driving axis to contact the nail stop. Herein, this motion is also referred to as articulation. The bumper angle 973 of an upper bumper can cause the tip of the driver blade to radially move away or articulate away from the nail driving axis 599 toward the driver blade stop 800 and/or a position proximate to and/or in contact with a magnet, such as the home magnet 700.

The articulation angle can vary widely and can be in a range of from greater than zero to greater than 30°, or in a range of from 0.05° to 25°, or 0.75° to 20°, or 0.1° to 20°, or 0.5° to 10°, or 0.5° to 5°, or 0.75° to 5°, or 0.8° to 4°, or 0.9° to 2°, or 1° to 3°, or 1° to 5°, or 3° to 15°. In an embodiment, the articulation angle can be 1° or less, or 2° or less, or 3° or less, or 4° or less, or 5° or less, or 10° or less, or 20° or less.

Figure 8:
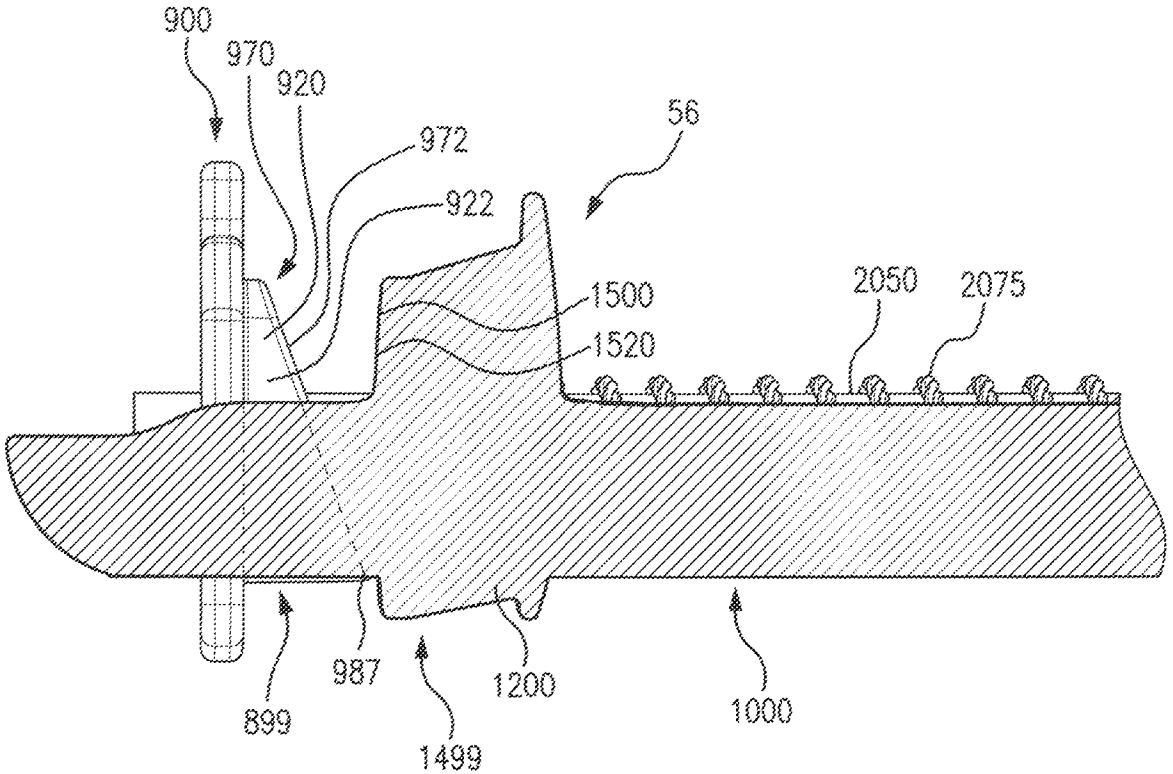
FIG. 8 is a close up view of a driver blade in a return configuration showing a driver blade ear proximate to an impact point.

FIG. 8 is a close-up view of the driver blade in a return configuration showing the second driver blade ear 1200 proximate to a pivot point 987 of the bumper 899. In the embodiment of FIG. 8, the articulation angle 719 of the driver blade tip 500 from the nail driving axis 599 will be about 1° upon impact with the bumper 899. In an embodiment, the driver blade 54 and driver blade tip 500 are articulated from the nail driving axis 599 at an angle of about 1°, or 2°, or 3°, or 4°, or 5° to strike the tip portion 552 into the driver blade stop 800.

Figure 9:
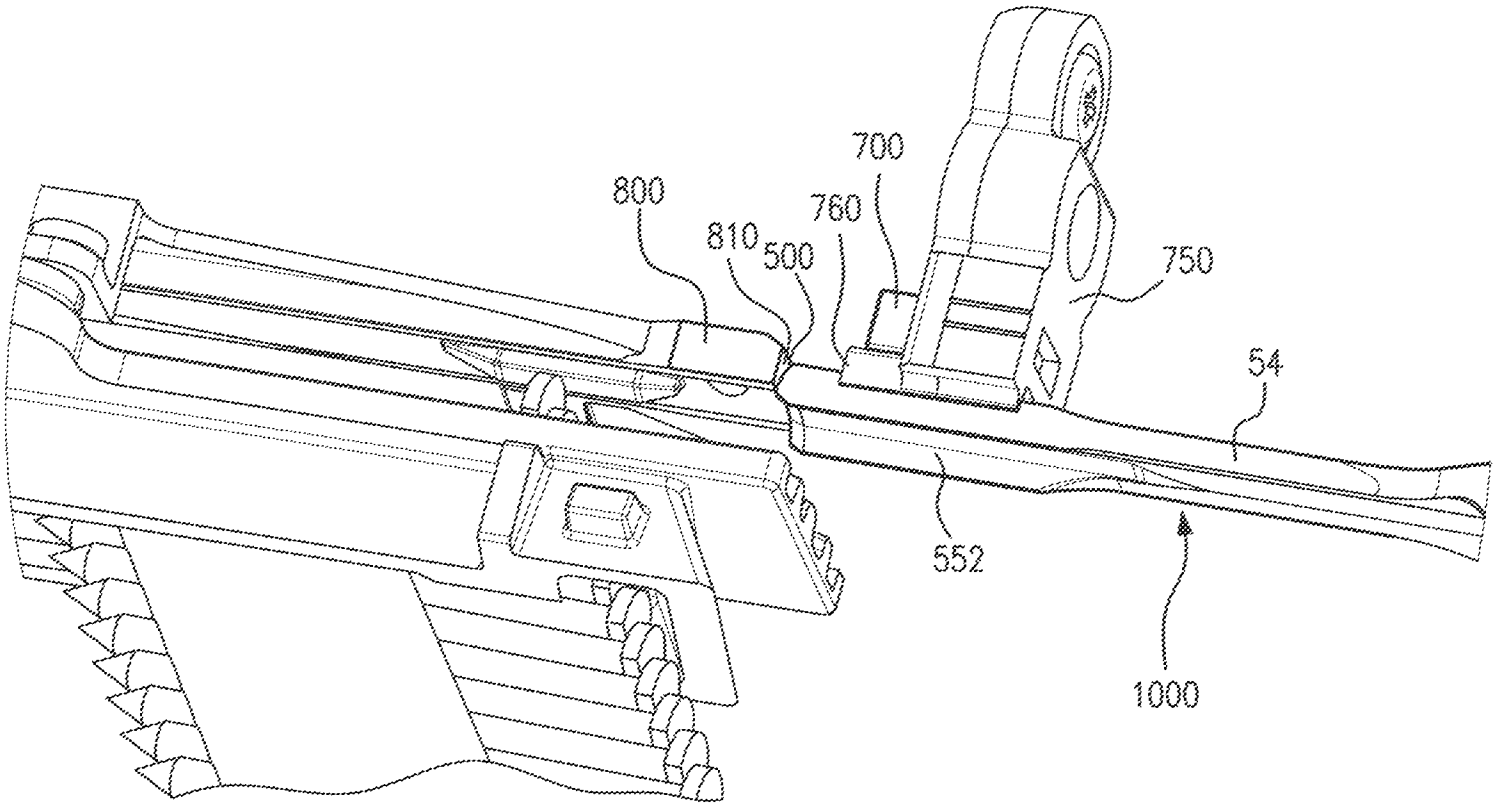
FIG. 9 is a driver blade stop close up view in which the driver blade tip is in contact with the driver blade stop.

FIG. 9 is a close-up view in which the driver blade tip 500 is in contact with the driver blade stop 800.

Figure 10:
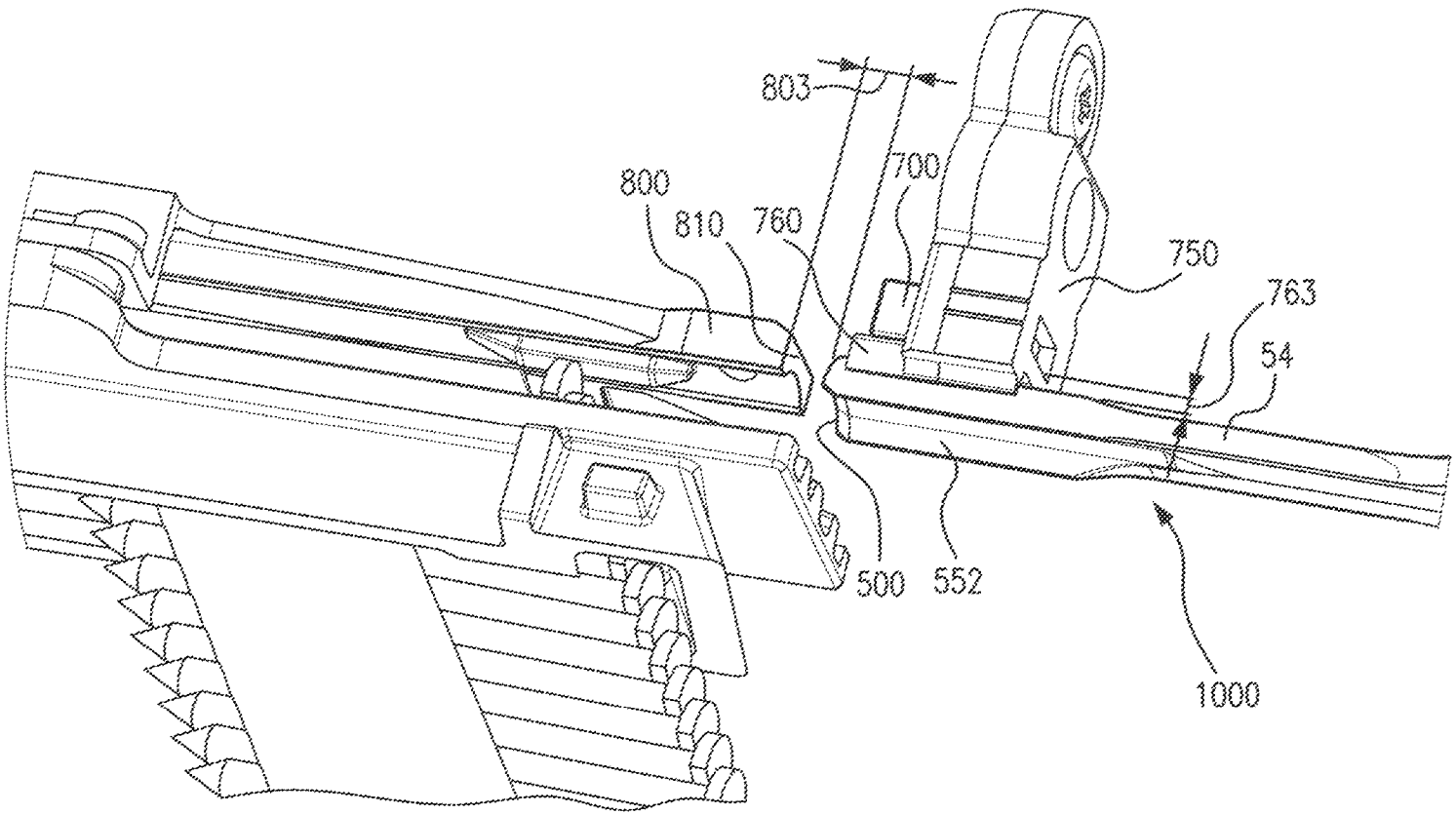
FIG. 10 is a driver blade stop close up view in which the driver blade tip is not in contact with the driver blade stop.

FIG. 10 is a close-up view in which the driver blade tip 500 is in contact with the driver blade stop 800. FIG. 10 shows the driver blade 54 at rest in a home position in which the tip portion 552 can have the driver blade tip 500 that is seated in a home seat 760. The home seat can have a home seat thickness 763. The home magnet holder 750 can provide support for at least a part of home magnet 700.

In FIG. 10, the tip portion 552 is resting against the home seat 760 and is experiencing a magnetic attraction from the home magnet 700. The home seat 760 can be a portion of the home magnet holder 750 or can optionally be a separate piece. The home seat 760 can serve to protect the magnet from abrasion by the tip portion 552 and also to influence the strength of the magnetic effects of the home magnet 700 by varying its thickness, materials of construction or physical properties. The strength of the home magnet 700 and the home seat thickness can be used to limit the magnetic force attracting the driver blade 54.

In an embodiment, the home seat 760 can have a home seat thickness 763 of 0.25 mm, or 5 mm, or greater. The home seat thickness 763 (FIG. 10) can be dependent upon the material of construction of the home seat 760. For example, if the home seat 760 is plastic, then the home seat thickness can be in a range of 0.25 mm to 5 mm, or 0.5 mm to 3 mm, or 1 mm to 4 mm, such as 0.8, or 1 mm, or 2 mm, or 3 mm, or 4 mm. In another example, if the home seat 760 is metal, such as a sheet metal, then the home seat thickness can be in a range of 0.15 mm to 4 mm, or 0.25 mm to 3 mm, or 0.5 mm to 3 mm, or 0.75 mm to 1.5 mm, such as 0.5 mm, or 0.8 mm, or 1 mm, or 2 mm, or 3 mm. In yet another example, if the home seat 760 is rubber or other polymer, then the home seat thickness can be in a range of 0.25 mm to 5 mm, or 0.5 mm to 3 mm, or 1 mm to 4 mm, such as 0.8, or 1 mm, or 2 mm, or 3 mm, or 4 mm.

For example, the home seat thickness 763 can be selected to limit the magnetic force of attraction to the tip portion to, less than 10 lbf, or less than 5 lbf, or less than 3 lbf, or less than 2 lbf, or less than 1 lbf; such as 1 lbf, or 2 lbf, or 3 lbf. In an embodiment, the magnetic force of attraction of the home magnet 700 is strong enough to hold the tip portion 552 in the home position and also magnetically low enough to allow the tool to drive nails. In an embodiment, 2 lbf of magnetic force upon the tip portion 552 can hold the driver blade 54 proximate to the driver blade stop 800, while allowing the activating mechanism to push the driver blade 54 away from the home magnet 700 and into with the nail driving axis 599 and to allow the activating mechanism to drive a nail. In an embodiment, the magnetic force of 2 lbf upon the tip portion 552 can also be used in high temperature and low voltage conditions where the activating mechanism and/or the driving solenoid force is reduced.

FIG. 10 also shows the tip portion 552 resting at a distance, defined by the blade stop gap 803, from the strike surface 810 of blade stop 800 to the driver blade tip 500.

Figure 11:
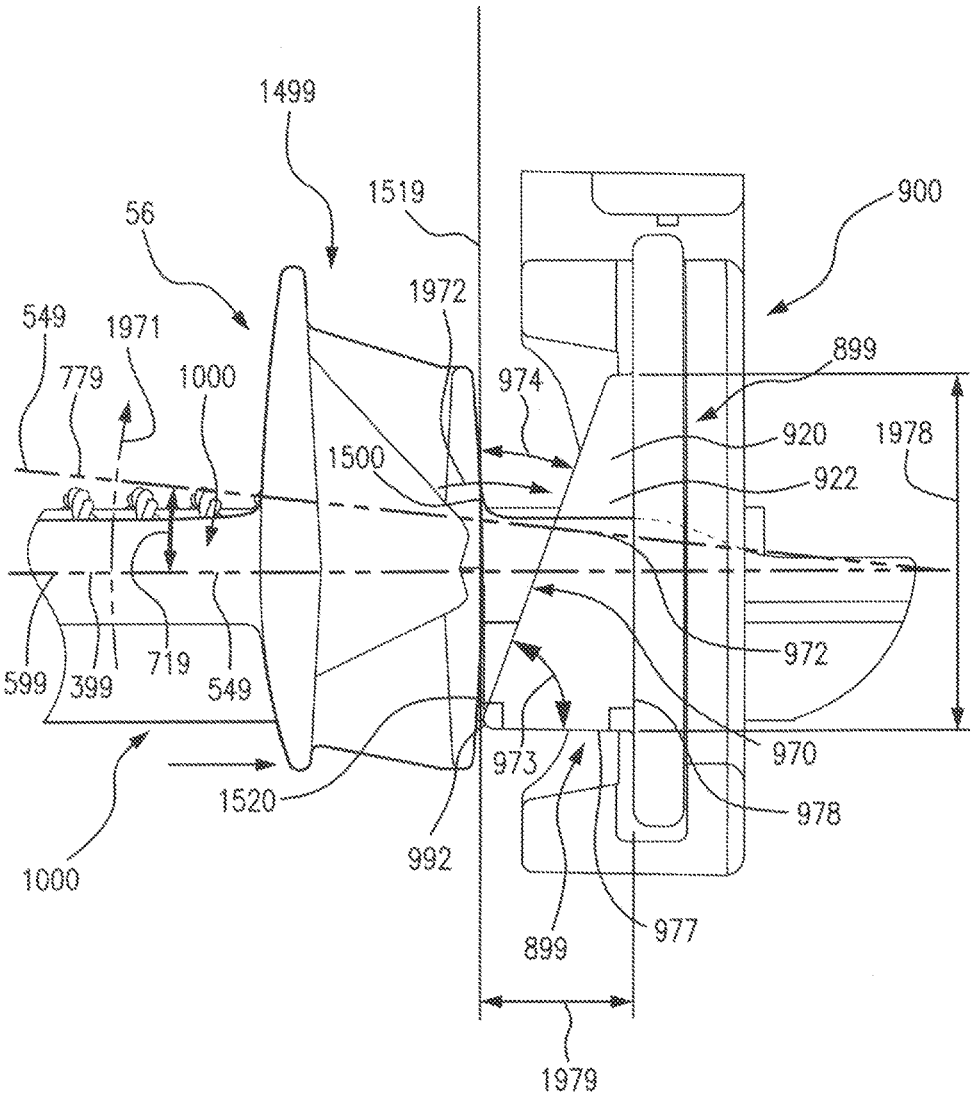
FIG. 11 is a close up view of the tail portion of the driver blade at the moment of contact with a bumper.

FIG. 11 is a close up view of the tail portion 56 of the driver blade 54 at the moment of contact with the bumper 899. In the example of FIG. 11, the driver blade 54 has returned after striking a nail 53 along the nail driving axis 599 and in alignment with the drive path 399. This return path is only one of many variations of return paths which can cause a portion of the driver blade 54 to impact upon the bumper 899. In the example of FIG. 11, the driver blade axis 549 is collinear and/or along the nail driving axis 599.

FIG. 11 shows the precise moment when at least a portion of a pivot surface 1500 of a pivot portion 1499 of a tail portion 56 contacts a second pivot point 992 of a second bumper 920. A second bumper 920 is shown having a second bump surface 972. The second bumper 920 has a bumper angle 973 between the second bump surface 972 and the second bumper side 977. In this embodiment, the second bumper side 977 is perpendicular to the second bumper base line 978 of the second bumper base 979.

At the depicted moment of contact in FIG. 11, the second pivot surface 1520 of pivot surface 1500 is coplanar with pivot plane 1519. Pivot plane 1519, pivot surface 1520 and pivot plane 1519 are shown to be coplanar in FIG. 11 and are also shown as perpendicular to the second bumper side 977. Thus, the pivot surface 1500 is parallel to the second bumper base line 978.

Figure 13:
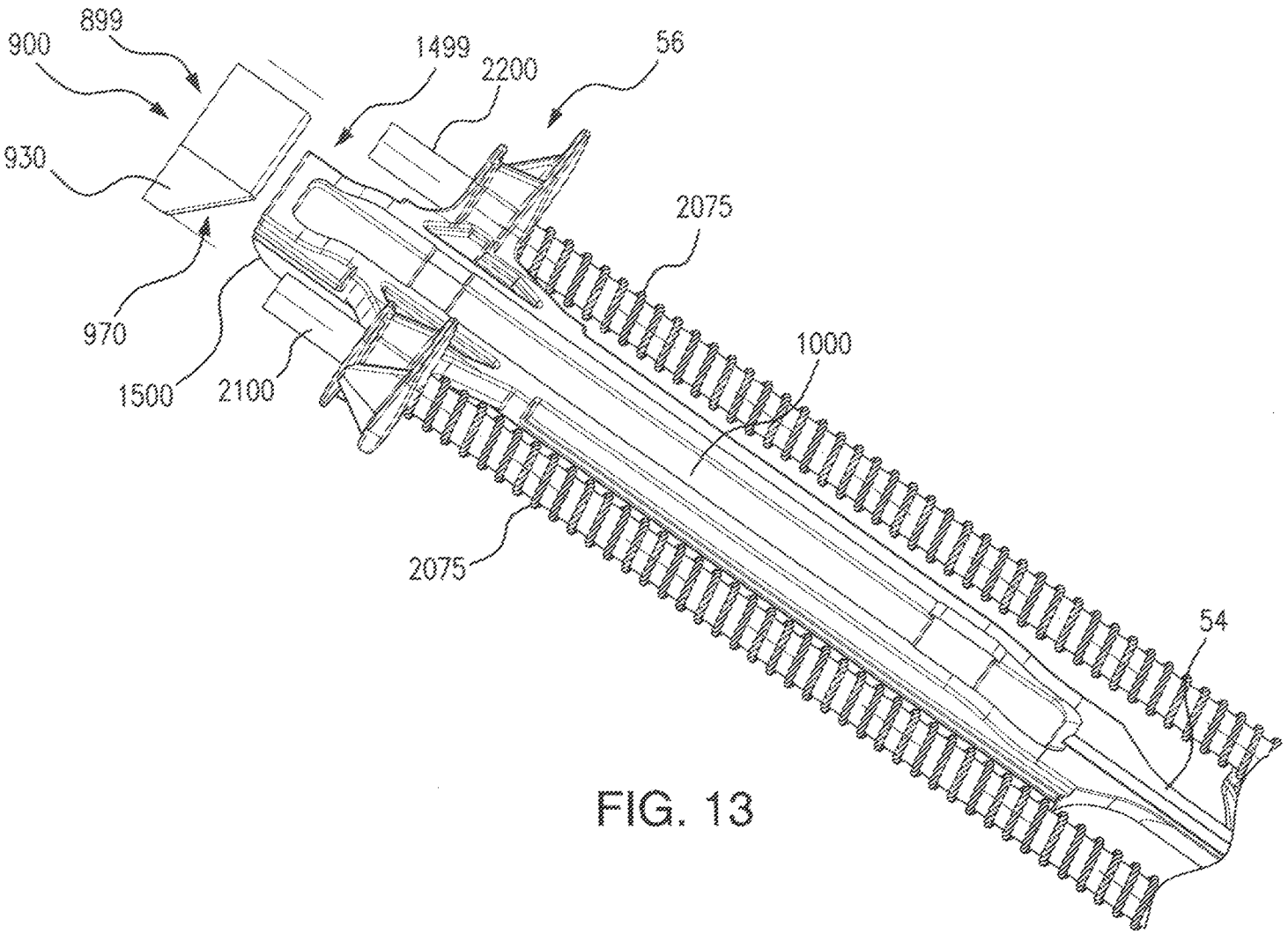
FIG. 13 is a perspective view of a driver blade and a center bumper.

FIG. 11 shows a pivot angle 974 which is formed between the pivot surface 1500 and the second bump surface 972. The displacement of the driver blade axis 549 can occur as shown by a displacement arrow 1972. The contact of the pivot surface 1500 to the second pivot point 996 causes the driver blade 54 to pivot such that the driver blade axis 549 moves out of alignment with the nail driving axis 599 and shown by articulation arrow 1971. As the pivoting and/or tilting increases the articulation angle 719 increases. FIG. 13 shows perspective view of the configuration of first bumper 910 and second bumper 920 for an embodiment which has a number of the bumper 899.

For example, FIG. 11 shows an articulation angle 719 which by pivoting in rotationally in the direction of the displacement arrow 1972 creates angle which orients the driver blade axis 549 along a displacement axis 779. FIG. 3G shows the configuration of the tip portion 552 upon a displacement of the driver blade axis 549 to an articulation angle 719.

FIGS. 12A-12F show a variety of types of the bumper 899. This disclosure is not limited regarding the types and kinds of bumper which can be used. The bumper 899 can be a single bumper or multiple bumpers. The bumpers can be made from any material which can absorb and/or withstand a shock and/or impact from a portion of the driver blade 54.

Figure 12A:
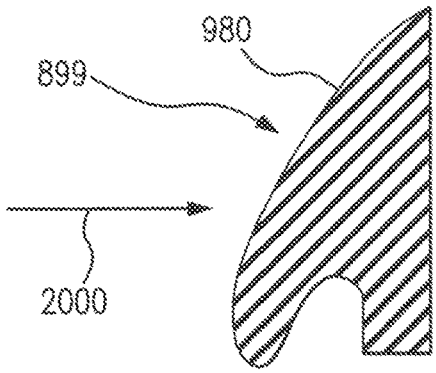
FIG. 12A shows a curving bumper.

FIG. 12A shows a curving bumper. A bumper 899 can be of any shape which can impart a moment resulting in an articulation and/or pivot of the driver blade 54 upon impact. The example of FIG. 12A shows an crescent shaped bumper made from a bumper material 980 which can reversibly deform when impacted by a portion of the driver blade 54 from the impact direction shown by impact direction arrow 2000.

Figure 12B:
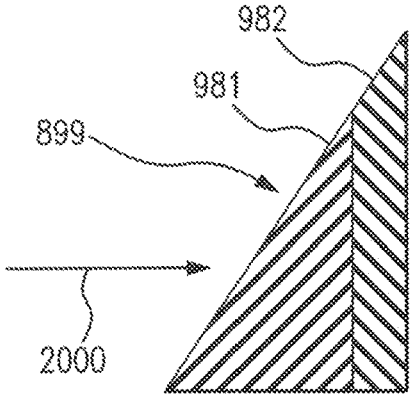
FIG. 12B shows a bumper having two bumper materials.

FIG. 12B shows a bumper having two bumper materials which are layered perpendicularly to impact direction arrow 2000. FIG. 12B shows an example embodiment of a bumper made from the first bumper material 981 and a second bumper material 981 which can be different.

Figure 12C:
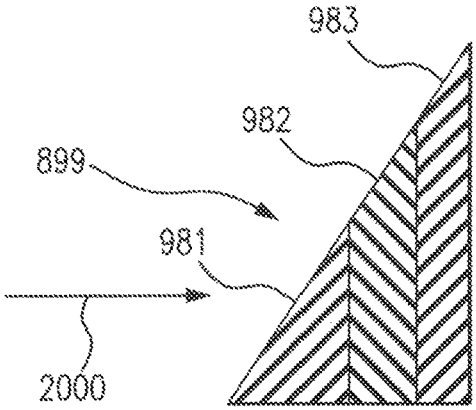
FIG. 12C shows a bumper having three bumper materials.

FIG. 12C shows the bumper 899 having three bumper materials. FIG. 12C shows an example embodiment of the bumper 899 made from the first bumper material 981, the second bumper material 982 and a third bumper material 983.

Figure 12D:
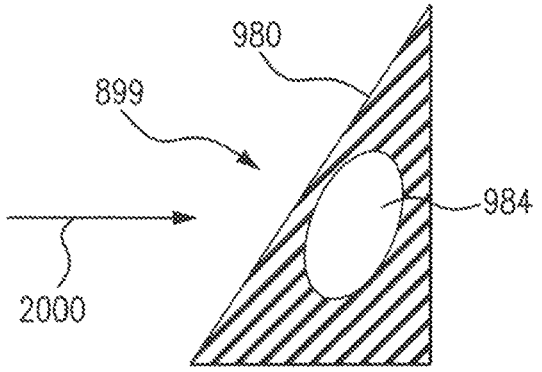
FIG. 12D shows a bumper having a shock absorber cell.

FIG. 12D shows the bumper 899 made from a first bumper material 981 and having a shock absorber cell 984. The shock absorber cell 984 can contain air, gel, liquid, or be made from a material different from the first bumper material 981. The bumper 899 can have multiple densities, phases and physical properties, as well be made from multiple materials.

Figure 12E:
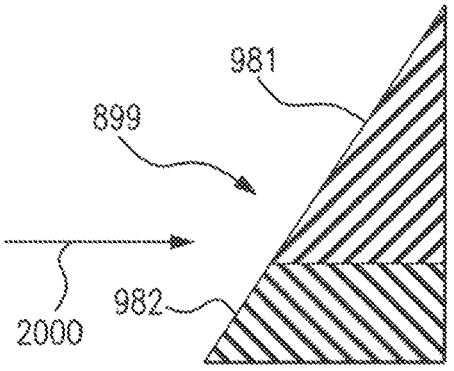
FIG. 12E shows a bumper having two axial layers.

FIG. 12E shows a bumper having two axial layers. FIG. 12E show an embodiment of the bumper 899 having a first bumper material 981 and a second bumper material 982 which are layered such that the interface between the layers is parallel to the impact direction shown by impact direction arrow 2000 forming two axially oriented layers. In an embodiment, the second bumper material 982 can have a higher density or higher resistance to deformation that the first bumper material 981 because it absorbs an impact from a portion of the driver blade 54 during the return phase prior to the second bumper material 982. In an embodiment, the a second bumper material 982 can have a lower density or lower resistance to deformation than the first bumper material to provide increased cushioning upon initial impact of bumper 899 by the driver blade 54. Which one of the first bumper material 981 and the second bumper material 982 is chosen to make denser can vary with the amount of articulation of the driver blade 54 desired upon impact with bumper 899.

Figure 12F:
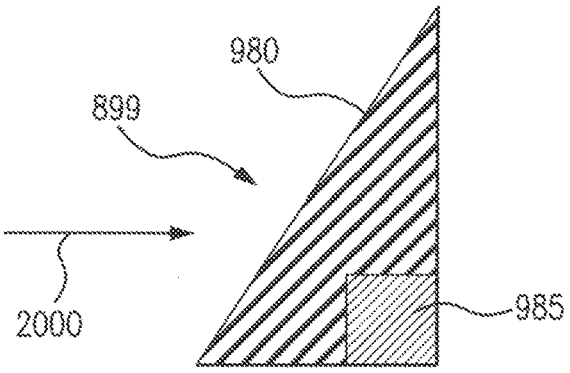
FIG. 12F shows a bumper having a bumper backstop.

FIG. 12F shows the bumper 899 having a bumper backstop 985. In embodiment, the bumper backstop 985 can be used to reinforce, or modify the behavior of, a bumper upon impact. For example under a high energy and/or high-speed driver blade 54 return condition a blade stop having a higher density can be used to ensure a desired articulation.

FIG. 13 is a perspective view of the driver blade 54 and the bumper 899, which is a center bumper 930. In non-limiting example, FIG. 13 shows the return bumper system 900 with the center bumper 930 and which is configured to receive an impact from a portion of a driver blade body 1000. The center bumper 930 is show having bump surface 970 which will cause the driver blade 54 to articulate upon impact with the center bumper 930.

Figure 14:
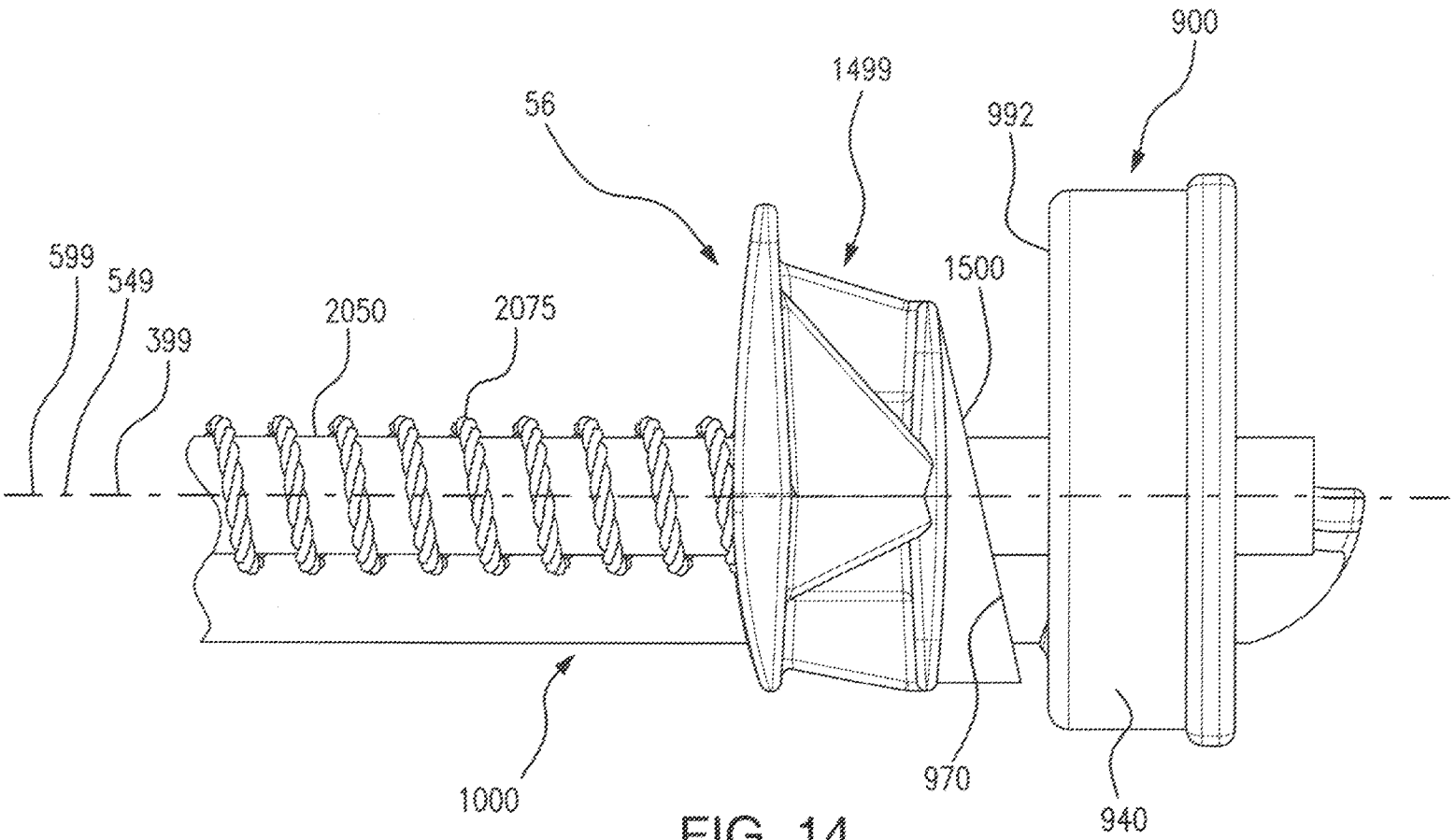
FIG. 14 is a perspective view of a driver blade and a flat bumper.

FIG. 14 is a perspective view of the driver blade 54 and a flat bumper 940. In the embodiment of FIG. 14 the bumper 899 has an impact surface 992 which is perpendicular to the driver blade axis 549. The tail portion 56 has a bump surface 970 which is not parallel to the impact surface 992 and will cause the driver blade 54 to articulate and/or pivot such that the driver blade axis 549 will move out of alignment with the nail driving axis 599 and/or the drive path 399 and form an articulation angle 719.

This scope disclosure is to be broadly construed. It is intended that this disclosure disclose equivalents, means, systems and methods to achieve the devices, activities and mechanical actions disclosed herein. For each mechanical element or mechanism disclosed, it is intended that this disclosure also encompass in its disclosure and teaches equivalents, means, systems and methods for practicing the many aspects, mechanisms and devices disclosed herein. Additionally, this disclosure regards a fastening tool and its many aspects, features and elements. Such a tool can be dynamic in its use an operation, this disclosure is intended to encompass the equivalents, means, systems and methods of the use of the tool and its many aspects consistent with the description and spirit of the operations and functions disclosed herein. The claims of this application are likewise to be broadly construed.

The description of the inventions herein in their many embodiments is merely exemplary in nature and, thus, variations that do not depart from the gist of the invention are intended to be within the scope of the invention. Such variations are not to be regarded as a departure from the spirit and scope of the invention.

I claim:

1. A fastening tool, comprising:

a nail driving axis;

a driver blade having a unitary body configured to drive a nail along the nail driving axis into a workpiece during a nail driving phase; and a nail channel having at least a portion aligned with the nail driving axis, wherein the nail driving channel is configured to receive the nail at a position along the nail driving axis before the nail is driven by the driver blade, wherein the nail driving axis is configured to extend along at least a portion of the longitudinal length of the nail when the nail is driven into the workpiece, wherein the driver blade has a driver blade axis that is a longitudinal axis extending along at least a portion of the driver blade, and wherein the driver blade axis is out of alignment with the nail driving axis during a portion of a return phase.

2. The fastening tool according to claim 1, further comprising:

a bumper adapted for reversible contact by the driver blade during the return phase.

3. The fastening tool according to claim 1, further comprising:

a bumper configured to cause the driver blade axis to have a configuration out of alignment with the nail driving axis.

4. The fastening tool according to claim 1, wherein a surface of a portion of the driver blade is configured to cause the driver blade axis to be out of alignment with the nail driving axis.

5. The fastening tool according to claim 1, wherein a surface of the driver blade is configured to cause the driver blade axis to be out of alignment with the nail driving axis and adapted to have a reversible contact with at least a portion of a bumper during at least a portion of the return phase.

6. The fastening tool according to claim 1, wherein the driver blade axis forms an angle with the nail driving axis during at least a portion of the return phase.

7. The fastening tool according to claim 1, wherein the driver blade axis is parallel to the nail driving axis during at least a portion of the nail driving phase.

8. The fastening tool according to claim 1, wherein the driver blade axis is generally aligned with the nail driving axis during at least a portion of the nail driving phase.

9. The fastening tool according to claim 1, wherein the driver blade axis is generally collinear to the nail driving axis during the nail driving phase.

10. The fastening tool according to claim 1, further comprising:

a driver blade stop configured to have a reversible contact with at least a portion of a driver blade.

11. The fastening tool according to claim 1, wherein the driver blade is configured to impact a driver blade stop during the return phase.

12. The fastening tool according to claim 1, wherein a portion of the driver blade is proximate to a magnet during a portion of the return phase.

13. The fastening tool according to claim 1, wherein at least a portion of a bumper and at least a portion of the driver blade form a pivot angle upon initial contact of the bumper and the driver blade during a portion of the return phase.

14. The fastening tool according to claim 1, further comprising:

a magnet which magnetically attracts at least a portion of the driver blade during the return phase.

15. The fastening tool according to claim 1, further comprising:

a bumper adapted for impact by the driver blade during a portion of the return phase;

a driver blade stop adapted for impact by the driver blade during a portion of the return phase; and a magnet which magnetically attracts at least a portion of the driver blade during a portion of the return phase.

16. A fastening tool, comprising:

a nail driving axis; and a driver blade configured to drive a nail along the nail driving axis into a workpiece during a nail driving phase, wherein the driver blade has a driver blade axis, wherein a bumper is located proximal to a tail portion of the driver blade during a portion of a return phase, and wherein the bumper is configured to cause the driver blade axis to have a configuration out of alignment with the nail driving axis during a portion of a return phase.

17. The fastening tool according to claim 16, wherein a surface of the driver blade is configured to cause the driver blade axis to be out of alignment with the nail driving axis and adapted to have a reversible contact with at least a portion of the bumper during at least a portion of the return phase.

18. The fastening tool according to claim 16, wherein the driver blade is configured to impact a driver blade stop during the return phase.

19. A fastening tool, comprising:

a nail driving axis;

a driver blade having a unitary body configured to drive a nail along the nail driving axis into a workpiece during a nail driving phase;

wherein the driver blade has a driver blade axis; and wherein a surface of a portion of the driver blade is configured to cause the driver blade axis to be out of alignment with the nail driving axis during a portion of a return phase.

20. The fastening tool according to claim 19, wherein the driver blade is configured to impact a driver blade stop during a portion of the return phase.

21. The fastening tool according to claim 19, further comprising:

a bumper configured to cause the driver blade axis to have a configuration out of alignment with the nail driving axis during a portion of the return phase.

22. The fastening tool according to claim 19, further comprising:

a magnet which magnetically attracts at least a portion of the driver blade during a portion of the return phase.

23. The fastening tool according to claim 19, further comprising:

a bumper adapted for impact by the driver blade during a portion of the return phase;

a driver blade stop adapted for impact by the driver blade during a portion of the return phase; and a magnet which magnetically attracts at least a portion of the driver blade during a portion of the return phase.

24. A fastening tool, comprising:

a nail driving axis;

a driver blade having a unitary body configured to drive a nail along the nail driving axis into a workpiece during a nail driving phase;

wherein the driver blade has a driver blade axis;

wherein a bumper is configured to have reversible contact with at least a portion of the driver blade during a portion of a return phase; and wherein at least a portion of the bumper and at least a portion of the driver blade form a pivot angle upon initial contact of the bumper and the driver blade during a portion of the return phase.

25. The fastening tool according to claim 24, wherein the driver blade is configured to impact a driver blade stop during a portion of the return phase.

26. A fastening tool, comprising:

a nail driving axis; and a driver blade having a unitary body configured to drive a nail along the nail driving axis into a workpiece during a nail driving phase;

wherein the nail driving axis is configured to extend along at least a portion of the longitudinal length of the nail when the nail is driven into the workpiece, wherein the driver blade has a driver blade axis that is a longitudinal axis extending along at least a portion of the driver blade, wherein the driver blade is adapted to receive a driving force through a frictional contact with a rotating member that imparts the driving force to the driver blade during the nail driving phase, and wherein the driver blade axis is out of alignment with the nail driving axis during a portion of a return phase.

27. The fastening tool according to claim 26, wherein the rotating member is a flywheel.

* * * * *